US012342935B1

(12) United States Patent
Crudo

(10) Patent No.: US 12,342,935 B1
(45) Date of Patent: Jul. 1, 2025

(54) ADJUSTABLE AEROLIFT LEGS

(71) Applicant: NPS Public Furniture Corp., Clifton, NJ (US)

(72) Inventor: Alexander Crudo, Hoboken, NJ (US)

(73) Assignee: NPS Public Seating Corp., Clifton, NJ (US)

( * ) Notice: Subject to any disclaimer, the term of this patent is extended or adjusted under 35 U.S.C. 154(b) by 0 days.

(21) Appl. No.: 19/039,291

(22) Filed: Jan. 28, 2025

(51) Int. Cl.
*A47B 9/10* (2006.01)

(52) U.S. Cl.
CPC ..... *A47B 9/10* (2013.01); *A47B 2200/005* (2013.01)

(58) Field of Classification Search
CPC ..... A47B 9/10; A47B 9/14; A47B 2200/005; A47B 2200/0051
See application file for complete search history.

(56) References Cited

U.S. PATENT DOCUMENTS 2,748,261 A * 5/1956 Wolar ..... F21V 21/22 248/407
5,598,788 A * 2/1997 Jonker ..... A47B 9/10 248/631
6,092,771 A * 7/2000 Fich ..... A47B 9/06 248/407
7,168,373 B1 * 1/2007 Hock ..... A47B 91/02 108/147.11
10,371,187 B2 * 8/2019 Hansen ..... A47B 9/06
10,595,629 B2 * 3/2020 Ko ..... F16C 33/542
10,918,202 B1 * 2/2021 Sie ..... A47B 9/06
10,926,983 B2 * 2/2021 Huang ..... A47B 9/10
11,172,757 B2 * 11/2021 Scharfenkamp ..... A47B 9/14
11,647,831 B2 * 5/2023 Pan ..... A47B 9/10 108/147
11,974,662 B1 * 5/2024 Crudo ..... A47B 13/003
11,992,118 B1 * 5/2024 Crudo ..... A47B 13/06
2014/0283715 A1 * 9/2014 Sevadjian ..... A47B 9/14 248/188.5

FOREIGN PATENT DOCUMENTS

KR 101033004 B1 * 5/2011
KR 101318938 B1 * 10/2013

* cited by examiner

*Primary Examiner* — Eret C McNichols
(74) *Attorney, Agent, or Firm* — Weiss & Arons LLP

(57) ABSTRACT

An adjustable Aerolift leg comprising an outer tube, an inner tube, a lock mechanism and an adjustment rail. The inner tube may slidably fit into the outer tube. The inner tube and outer tube may be a square shape, a triangular shape, a circular shape or an eye shape. The shape of the inner tube may or may not depend on the shape of the outer tube. The lock mechanism may be located at an end of the inner tube, between the outer tube and the inner tube. The lock mechanism may lock relative movements therebetween. The adjustment rail may be disposed inside the inner cylindrical tube which may be inside the outer cylinder. The adjustment rail may receive the lock mechanism at one of several positions.

8 Claims, 25 Drawing Sheets

Section 2-2

ADJUSTABLE AEROLIFT LEGS

FIELD OF TECHNOLOGY

Aspects of the disclosure relate to mechanical designs and apparatus. Specifically, aspects of the disclosure relate to furniture legs.

BACKGROUND OF THE DISCLOSURE

Furniture is equipment used to make a space suitable for living or working.

Typical furniture items are used for distinct functions. As such, multiple functions require the use of multiple furniture items. For example, a dining table is required for seating and dining, a stage table is required for performing and an American with Disabilities Act ("ADA")-compliant table, a table with a height sufficient to accommodate a wheelchair, is required for seating wheelchair-bound persons.

It may be desirable to create furniture items that accommodate multiple functions.

Furthermore, furniture may store or hold various objects. The objects may vary in weight. As such, the objects may be heavyweight, lightweight or any other weight.

Certain furniture items are supported by furniture legs. Furniture legs are furniture subcomponents that hold a furniture item in a position. Furniture legs are also used to evenly distribute the weight of the objects across a larger area.

At times, a furniture item does not adequately support the weight of an object. Insufficient support may result from weak, unsteady or deficient furniture legs. A furniture item supported by weak, unsteady or deficient furniture legs is prone to buckle or collapse from the weight of the objects.

Specifically, when creating furniture items that accommodate multiple functions, it may be further desirable for the furniture legs to adequately support various weights.

Therefore, it would be desirable to create an adjustable Aerolift leg, also referred to as an Aero-lift leg. The adjustable Aerolift leg may be adjustable to multiple heights.

It would be further desirable for the adjustable Aerolift leg to be sturdy, steady, and sufficient to hold various weights.

SUMMARY OF THE DISCLOSURE

Aspects of the disclosure relating to an adjustable Aerolift leg is provided. Methods, apparatus, and systems for an adjustable Aerolift leg, usage of the leg and manufacture of the leg are provided. Aerolift, for the purposes of this application, may be understood to mean use of an airtight chamber.

The adjustable Aerolift leg may include an outer tube, an inner tube, a lock mechanism and an adjustment rail.

The outer tube may extend along a longitudinal axis. The outer tube may be a square shape, a cylindrical shape, a diamond shape, a pointed oval shape (also referred to as a marquis shape or an elongated oval with pointed ends) or any other suitable shape. The outer tube may be a combination of multiple shapes. The outer tube may be hollow. The outer tube may include a material. The material of the outer tube may include any of the materials listed in Table 1.

TABLE 1

| Illustrative materials.<br>Illustrative materials. |
|---|
| Wood |
| Plastic |
| Metal |
| Aluminum |
| 18-gauge steel |
| 16-gauge steel |
| 13-gauge steel |
| 12-gauge steel |
| 11-gauge steel |
| 3-gauge steel |
| Any suitable gauge steel |
| Any other suitable materials |
| Any suitable combination thereof |

The height of the adjustable Aerolift leg may be a combination height. Combination heights may be a combined height of the outer tube and at least a portion of the inner tube. Combination height may be measured from a bottom of the leg to a portion of the leg attachable to a furniture surface. The combination height may be the combined height of the outer tube and the portion of the inner tube located external from the outer tube. The outer tube may include a height. The height of the outer tube may be any height listed in Table 2.

TABLE 2

| Illustrative heights<br>Illustrative heights |
|---|
| <0 mm-500 mm |
| 500 mm-550 mm |
| 550 mm-600 mm |
| 600 mm-650 mm |
| 650 mm->650 mm |
| Any other suitable height |

The outer tube may include a width. The width of the outer tube may include any width listed in Table 3.

TABLE 3

| Illustrative widths<br>Illustrative widths |
|---|
| <0 mm-20 mm |
| 20 mm-40 mm |
| 40 mm-60 mm |
| 60 mm-80 mm |
| 80 mm->100 mm |
| Any other suitable widths |

The adjustable Aerolift leg may include an inner tube. The inner tube may slidably fit into the outer tube. The inner tube may be a square shape, cylindrical shape, diamond shape, pointed oval shape or any other suitable shape. The inner tube may fit at least partially into the outer tube. The inner tube may slide within the outer tube along a longitudinal axis.

In some embodiments, the inner tube may slide completely into the outer tube. In other embodiments, the inner tube may slide partially into the outer tube. There may be a portion of the inner tube located outside of the outer tube. As discussed above, the combination height may be the combined height of the outer tube and the portion of the inner tube outside of the outer tube. The height of the inner tube may measure any height listed in Table 2. The width of the inner tube may measure any width listed in Table 3.

The adjustable Aerolift leg may include a lock mechanism. The lock mechanism may include any length as listed in Table 4.

TABLE 4

| Illustrative lengths<br>Illustrative lengths |
|---|
| <0 mm-20 mm |
| 20 mm-40 mm |
| 40 mm-60 mm |
| 60 mm-70 mm |
| 70 mm->80 mm |
| Any other suitable length |

The lock mechanism may include any width listed in Table 5.

TABLE 5

| Illustrative widths<br>Illustrative widths |
|---|
| <0 mm-20 mm |
| 20 mm-30 mm |
| 30 mm-40 mm |
| 40 mm-50 mm |
| 50 mm->60 mm |
| Any other suitable width |

The lock mechanism may be located at an end of the inner tube. The end of the inner tube may be a bottom end with respect to the ground. The lock mechanism may be located inside the inner tube and the outer tube. The lock mechanism may lock movements between the outer tube and the inner tube.

The adjustable Aerolift leg may include an adjustment rail. The adjustment rail may include any height listed in Table 2. The adjustment rail may include a plurality of holding members. There may be 15, 16, 17, 18, 19, 20 or any other suitable number of holding members. The adjustment rail may be located within the inner tube. The lock mechanism, in conjunction with the adjustment rail, may lock movements between the outer tube and the inner tube using the holding members.

When the inner tube slides within the outer tube, the lock mechanism may be operable to lock into one of the holding members. As such, the inner tube may lock into a position. The inner tube may slide up the adjustment rail and the holding members. Once the lock mechanism passes a holding member, the inner tube may be prevented from returning to that holding member. Upon reaching a maximum height holding member, the inner tube may be enabled to return to a minimum height or a bottom position. When the lock mechanism returns to the minimum height, the lock mechanism may be enabled to slide upwards again. As such, the leg may be extendable, however the leg may not be retractable until it has reached the maximum extendibility.

It should be noted that the maximum height and the minimum height may be holding members. The maximum height holding member and the minimum height holding member may include a tapered surface on the portion of the adjustment rail corresponding to the maximum height and the minimum height. As such, the lock mechanism may not lock into the maximum height holding member or the minimum height holding member. Therefore, when the lock mechanism reaches the maximum height, the lock mechanism may slide down and return to the minimum height.

As such, the adjustable Aerolift leg may be adjustable. Furthermore, the adjustable Aerolift leg may be sturdy, steady, and sufficient to hold various weights.

BRIEF DESCRIPTION OF THE DRAWINGS

The objects and advantages of the disclosure will be apparent upon consideration of the following detailed description, taken in conjunction with the accompanying drawings, in which like reference characters refer to like parts throughout, and in which.

DETAILED DESCRIPTION OF THE DISCLOSURE

Figure 1:
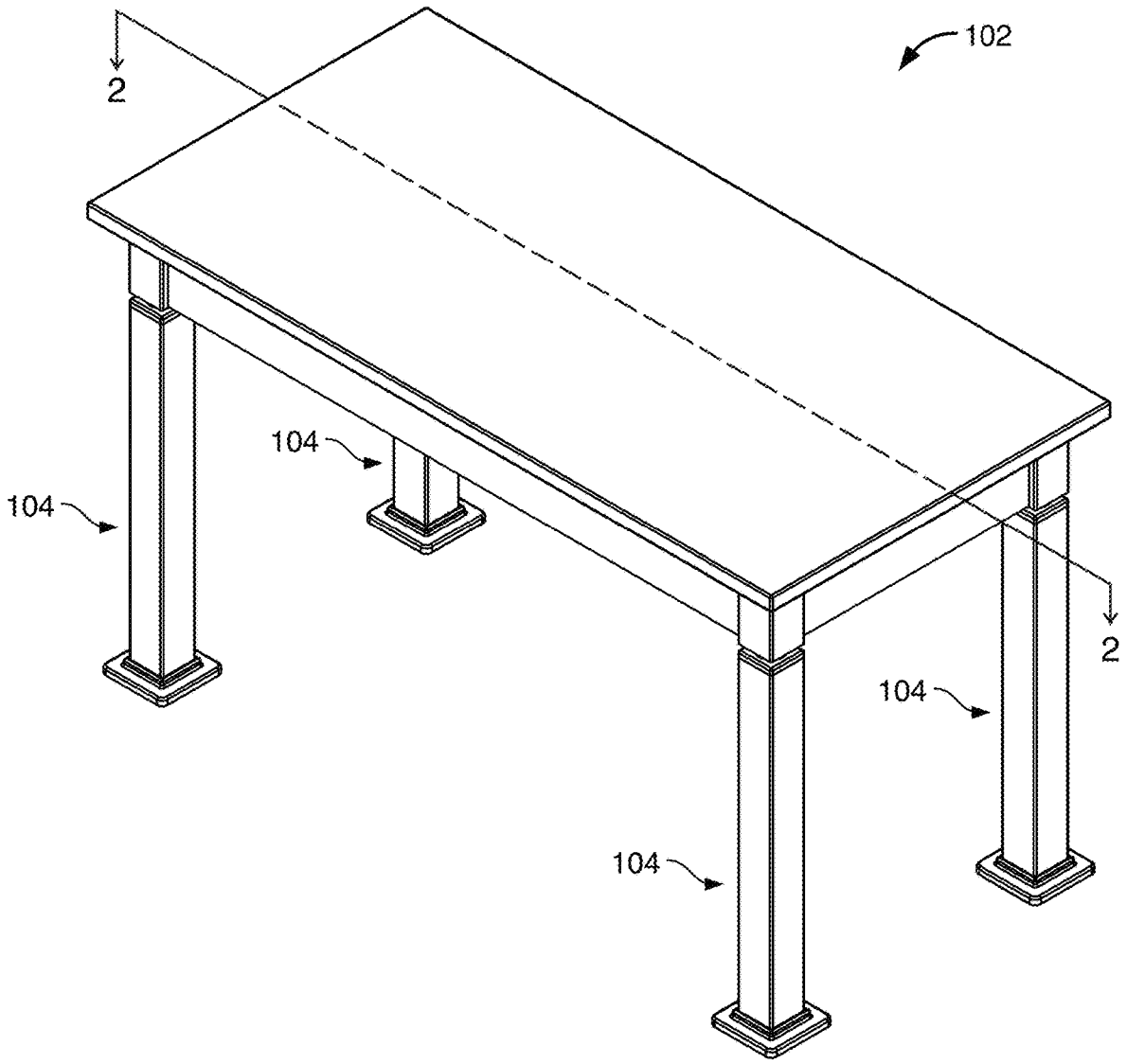
FIG. 1 shows an illustrative apparatus in accordance with principles of this matter.

Apparatus, methods and systems for an adjustable Aerolift leg is provided.

An adjustable Aerolift leg may include an outer square tube. The outer square tube may extend along a longitudinal axis. The outer square tube may include a material. The material of the outer square tube may include any material listed in Table 1.

The adjustable Aerolift leg may include an inner cylindrical tube. The inner cylindrical tube may slidably fit at least partially within the outer square tube. The inner cylindrical tube may extend along the longitudinal axis. The inner cylindrical tube may slide within the outer square tube along the longitudinal axis. The inner cylindrical tube may include a material. The material of the inner cylindrical tube may include any material listed in Table 1.

When the inner cylindrical tube is slidably fitted into the outer square tube, the inner cylindrical tube and outer square tube may form a plurality of combination heights. Table 6 shows illustrative combination heights.

TABLE 6

| Illustrative combination heights. Illustrative combination heights. |
|---|
| <0 mm-694 mm |
| 694 mm-714 mm |
| 714 mm-734 mm |
| 734 mm-754 mm |
| 754 mm-774 mm |
| 774 mm-794 mm |
| 814 mm-834 mm |
| 834 mm-854 mm |
| 854 mm-874 mm |
| 874 mm-894 mm |
| 894 mm-914 mm |
| 914 mm-934 mm |
| 934 mm-954 mm |
| 954 mm-974 mm |
| 974 mm-994 mm |
| 994 mm-1014 mm |
| 1014 mm-1034 mm |
| 1034 mm->1054 mm |
| Other suitable combination height ranges |

The inner cylindrical tube may slide within the outer square tube. The inner cylindrical tube may "click" within the outer square tube, thereby forming a combination height. Combination heights may be a combined height of the outer square tube and at least a portion of the inner cylindrical tube. A combination height may be measured from a bottom of the leg to a portion of the leg attachable to a furniture surface. A furniture surface may be a tabletop, a seat and/or any other suitable furniture surface.

When the inner cylindrical tube slides within the outer square tube, the inner cylindrical tube may lock in at one of a plurality of holding members. The combination height may include a height of the outer square tube and a height of the inner cylindrical tube that extends from the outer square tube. The combination height may correspond to the holding member which is engaged with the lock mechanism. As such, when a first holding member is engaged with the lock mechanism, the combination height may measure a first measurement, and when a second holding member is engaged with the lock mechanism, the combination height may measure a second measurement. It should be noted that while the outer square tube may remain static, the inner cylindrical tube may be slidable within the outer square tube.

The inner cylindrical tube may slidably fit into the outer square tube. It should be appreciated that the outer square tube may be a square tube while the inner cylindrical tube may be a circular tube. As such, the adjustable Aerolift leg may have strength greater than that of a fully circular leg. However, there may be excess air when a cylindrical tube slides into a square tube. The excess air may cause the movement between the inner cylindrical tube and the outer square tube to be rough. Therefore, the adjustable Aerolift leg may further include a mount flange assembly. A mount flange assembly may be used to make the adjustable Aerolift leg airtight. When the adjustable Aerolift leg is airtight, movements between the inner cylindrical tube and the outer square tube may be smooth.

The mount flange assembly may be fixedly coupled to a first end of the inner cylindrical tube. The mount flange assembly may maintain airtightness of the inner cylindrical tube when the inner cylindrical tube slides within the outer square tube. A portion of the mount flange assembly may be shaped in a marquis or pointed oval shape. As such, a plurality of corners of the mount flange assembly may fit into a plurality of corners of the outer square tube. The plurality of corners of the outer square tube may include two opposite corners. The two opposite corners of the outer square tube may fit into the two corners of the mount flange assembly.

The adjustable Aerolift leg may include a lock mechanism. The lock mechanism may be located at a second end of the inner cylindrical tube. The second end of the inner cylindrical tube may be opposite the first end of the inner cylindrical tube. The inner cylindrical tube may include a lock mechanism on the first end and a mount flange assembly on the second end. The lock mechanism may be located at the second end of the inner cylindrical tube with respect to the ground.

When the inner cylindrical tube is situated in a vertical position, where a first end is located further from the ground and the second end is located near the ground, movements between the inner cylindrical tube and the outer square tube may be locked. When the lock mechanism is engaged, the lock mechanism may prevent movement between the inner cylindrical tube and the outer square tube. When the lock mechanism is disengaged, (as described elsewhere in the specification) the lock mechanism may enable movement between the inner cylindrical tube and the outer square tube.

The adjustable Aerolift leg may include an adjustment rail. The adjustment rail may be disposed inside the inner cylindrical tube. The adjustment rail may be disposed inside the inner cylindrical tube and the outer square tube. The adjustment rail may be mounted to a bottom portion of the outer square tube. However, the adjustment rail may not be mounted to the inner cylindrical tube. Because the adjustment rail is not mounted to the inner cylindrical tube, the inner cylindrical tube may be movable with respect to the outer square tube. The adjustment rail may include a plurality of holding members. The holding members may be used for engaging with the lock mechanism. The adjustment rail may include 1-20, 15-20 or preferably 19 or any other suitable number of holding members.

The lock mechanism may be used to adjust the leg to a plurality of combination heights. Each combination height may directly relate to a holding member. The adjustable Aerolift leg may adjust to 1-20, 15-20 or preferably 19 combination heights or any other suitable number of combination heights. The inner cylindrical tube and attached lock mechanism may slide upwards on the adjustment rail. As the lock mechanism passes each holding member, when sliding upwards, the lock mechanism may engage with a holding member.

It should be noted that the inner cylindrical tube slides upwards and downwards along a longitudinal axis. It should be noted that the inner cylindrical tube slides upwards from a minimum combination height to a maximum combination height. When the inner cylindrical tube and lock mechanism reach a maximum holding member, the inner cylindrical tube and lock mechanism may return to a minimum holding member. Upon engaging with the minimum holding member, the inner cylindrical tube may again be enabled to slide upwards along the longitudinal axis on the adjustment rail.

It should be noted that the maximum holding member may include a tapered surface. As such, a retractable protrusion within the lock mechanism may be engageable with the holding members within the adjustment rail, however, the retractable protrusion within the lock mechanism, may not be engageable with a holding member that includes a tapered surface. As such, the maximum holding member and corresponding height, which includes a tapered surface, may not be a height in which the adjustable leg can be locked. Furthermore, the minimum holding member and corresponding height, which includes a tapered surface, may not be a height in which the adjustable leg can be locked.

The lock mechanism may engage separately with each holding member. When the lock mechanism passes a holding member, the lock mechanism may not return to the holding member until the lock mechanism has reached both the maximum holding member and the minimum holding member. The lock mechanism may lock into each holding member when the lock mechanism slides past the holding member. It should be noted that once the lock mechanism engages with a holding member, and is de-engaged with the holding member, the lock mechanism and inner cylindrical tube may not return to the holding member with which the lock mechanism was previously engaged until the lock mechanism has re-reached the minimum holding member.

The maximum holding member may be located on the adjustable rail. The maximum holding member may be configured in a tapered configuration. As such, the maximum holding member may be referred to as a tapered holding member. Because the maximum holding member is configured in a tapered configuration, the lock mechanism may not be enabled to lock in at the maximum holding member. Upon reaching the maximum holding member, the inner cylindrical tube and lock mechanism may return to a minimum holding member.

The minimum holding member may be configured in a tapered configuration. As such, the minimum holding member may be referred to as a tapered holding member. Because the minimum holding member is configured in a tapered configuration, the lock mechanism may not be enabled to lock in at the minimum holding member. Upon reaching the minimum holding member, the inner cylindrical tube and the lock mechanism may be enabled to slide upwards and re-engage with the plurality of holding members.

The adjustable Aerolift leg may include a friction member. The friction member may be located at a first end of the outer square tube with respect to the top of the outer square tube. The friction member may be placed between the inner cylindrical tube and the outer square tube. The friction member may include a material. The material may be a flexible material, a stretchy material or any other suitable material. The material may include rubber, plastic or any other suitable material. The friction member may be configured in a circular shaped ring configuration. The friction member may provide friction between the outer square tube and the inner cylindrical tube. The friction member may provide a resistance when the inner cylindrical tube slides within the outer square tube. The resistance provided by the friction may maintain the strength of the leg.

Apparatus and methods described herein are illustrative. Apparatus and methods in accordance with this disclosure will now be described in connection with the figures, which form a part hereof. The figures show illustrative features of apparatus and method steps in accordance with the principles of this disclosure. It is understood that other embodiments may be utilized, and that structural, functional, and procedural modifications may be made without departing from the scope and spirit of the present disclosure. The steps of methods may be performed in an order other than the order shown and/or described herein. Embodiments may omit steps shown and/or described in connection with illustrative methods. Embodiments may include steps that are neither shown nor described in connection with illustrative methods.

Illustrative method steps may be combined. For example, an illustrative method may include steps shown in connection with another illustrative method.

Apparatus may omit features shown and/or described in connection with illustrative apparatus. Embodiments may include features that are neither shown nor described in connection with the illustrative apparatus. Features of illustrative apparatus may be combined. For example, an illustrative embodiment may include features shown in connection with another illustrative embodiment.

The drawings show illustrative features of apparatus and methods in accordance with the principles of the invention. The features are illustrated in the context of selected embodiments. It will be understood that features shown in connection with one of the embodiments may be practiced in accordance with the principles of the invention along with features shown in connection with another of the embodiments.

One of ordinary skill in the art will appreciate that the steps shown and described herein may be performed in other than the recited order and that one or more steps illustrated may be optional. The methods of the above-referenced embodiments may involve the use of any suitable elements, steps, computer-executable instructions or computer-readable data structures. In this regard, other embodiments are disclosed herein as well that can be partially or wholly implemented on a computer-readable medium, for example, by storing computer-executable instructions or modules or by utilizing computer-readable data structures. For example, methods for producing an apparatus may, in certain embodiments, be wholly or partially executed by designing the apparatus via software, such as computer aided design (CAD) software.

FIG. 1 shows illustrative table 102. Table 102 includes a tabletop, four legs 104, two short aprons and two long aprons. Legs 104 may be adjustable Aerolift legs. It should be noted that although legs 104 are shown as mounted to a tabletop, legs 104 may be mountable to a variety of additional furniture. Adjustable Aerolift leg 104 may be mountable to an underside of a tabletop, an underside of a chair, an underside of a stool, an underside of a bed, an underside of a desk and/or any other suitable furniture. Adjustable Aerolift leg 104 is adjustable to a plurality of different heights. As such, the tabletop and/or other furniture may be adjustable to different heights.

A tabletop may be used for a plurality of different purposes. The tabletop may be used as a stage table, an activity table, an ADA compliant table and/or for any other suitable purpose. The adjustable Aerolift legs may adjust to different heights. As such, the tabletop and legs may be used for multiple purposes. When adjusting the legs, the tabletop may be a stage tabletop, an activity tabletop, an ADA compliant tabletop or any other suitable tabletop.

One or more adjustable Aerolift legs may be mounted to a single furniture item. When two or more legs are mounted to a single furniture item, each of the legs may be adjusted to the same height. When two or more legs are mounted to a single furniture item, each of the legs may be adjusted to a different height. When a plurality of legs is mounted to a single furniture item, a first portion of the plurality of legs (one or more legs) may be adjusted to a first height, a second portion of the plurality of legs (one or more legs) may be adjusted to a second height and a third portion of the plurality of legs (one or more legs) may be adjusted to a third height. Any other suitable portion of the plurality of legs may be adjusted to any other suitable height. As such, the furniture item, with legs at different heights, may hold a supported object positioned on an angle. Furthermore, the furniture item, with legs at different heights, may be placed on a flat surface, on a surface with an incline, on steps or on any other suitable surface while retaining the strength of the furniture item and/or maintaining the top of the furniture item in a specific position and/or configuration.

Figure 2:
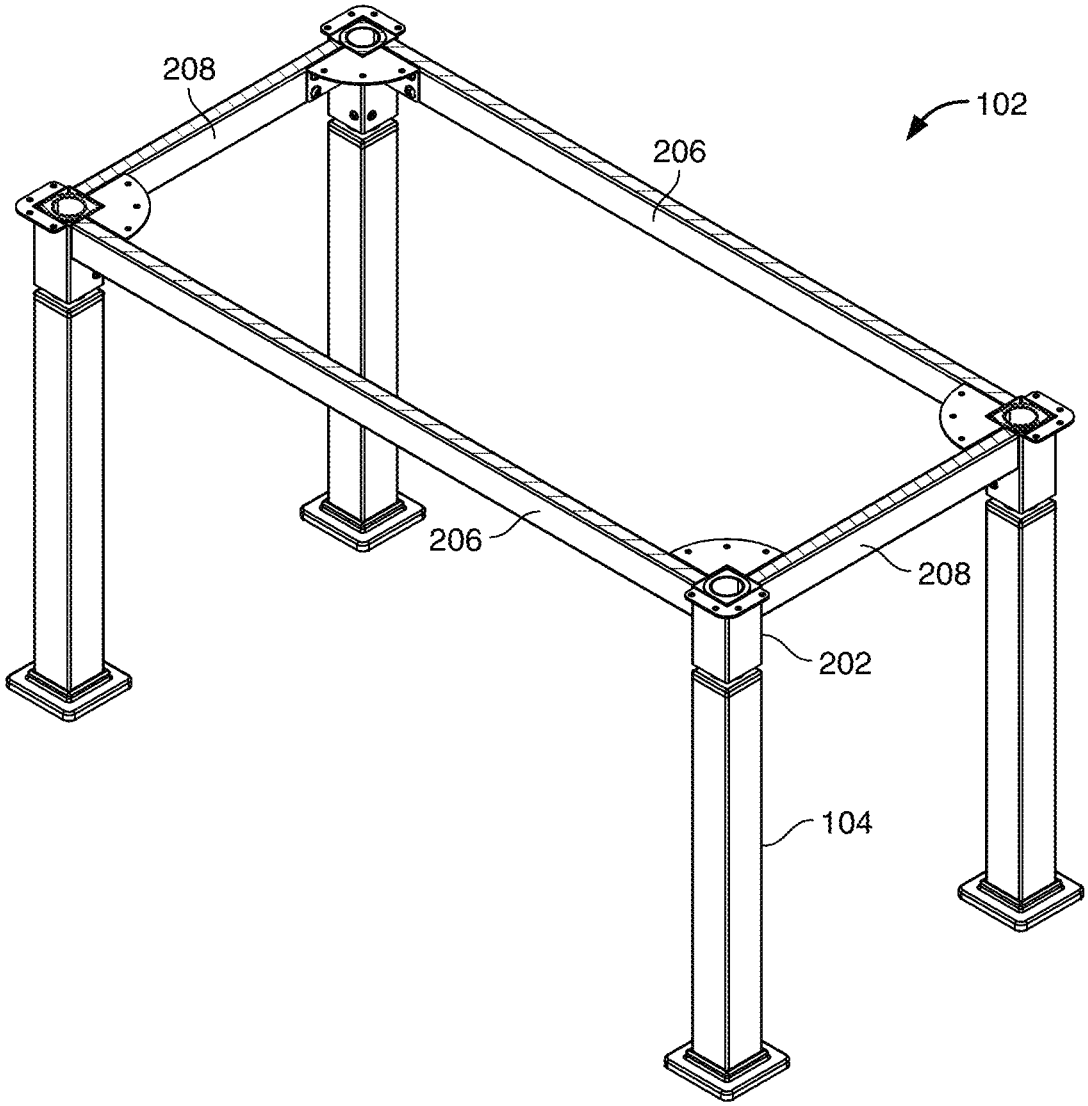
FIG. 2 shows a cross-sectional view of table 102 taken along view lines 2-2.

FIG. 2 shows a cross-sectional view of table 102 taken along view lines 2-2. Long aprons 206 may connect a first mounting portion 202 to a second mounting portion 202 along a long side of table 102. Short aprons 208 may connect a first mounting portion 202 to a second mounting portion 202 along a long side of table 102.

Figure 3:
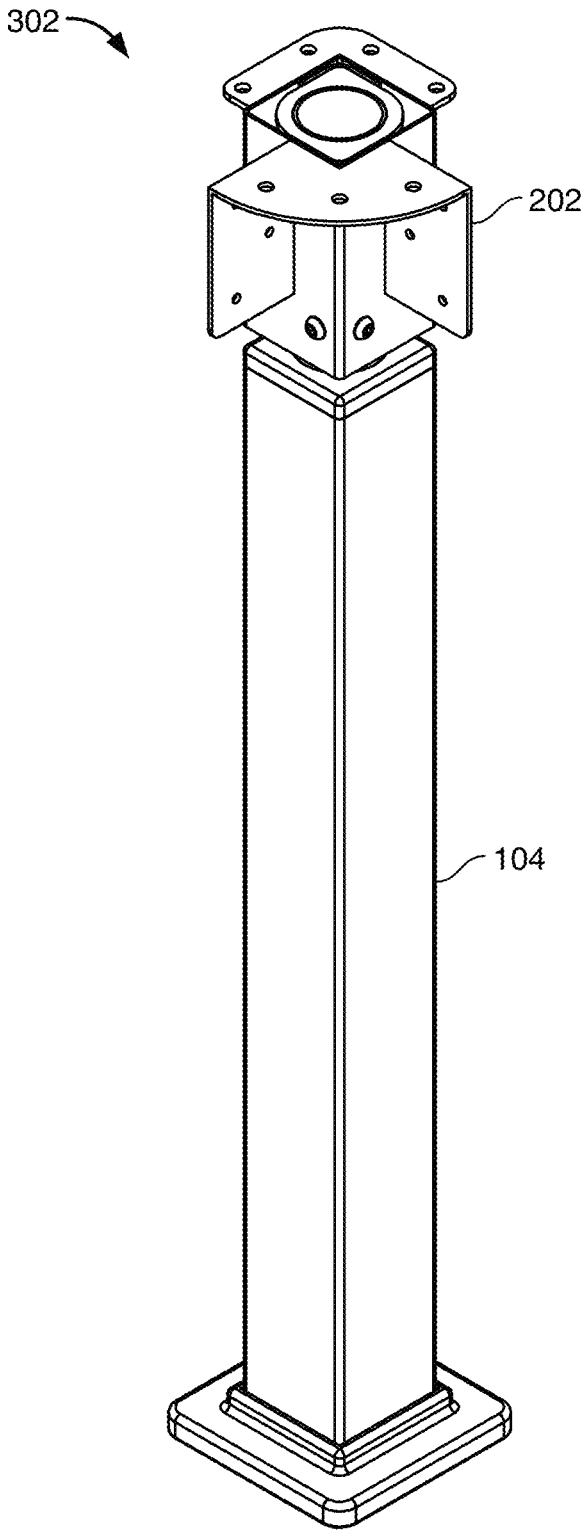
FIG. 3 shows an illustrative apparatus in accordance with principles of this matter.

FIG. 3 shows adjustable Aerolift leg assembly 302. Adjustable Aerolift leg assembly 302, shown in FIG. 3, may be a non-exploded view of adjustable Aerolift leg 104 and mounting portion 202. Adjustable Aerolift leg assembly 302 may include mounting portion 202. Adjustable Aerolift leg assembly 302 may be leg 104 mounted to an underside of a furniture item. Adjustable Aerolift leg assembly 302 may be shown at a minimum combination height. However, the adjustable Aerolift leg assembly 302 may be operable to lock in at a plurality of heights.

Figure 4C:
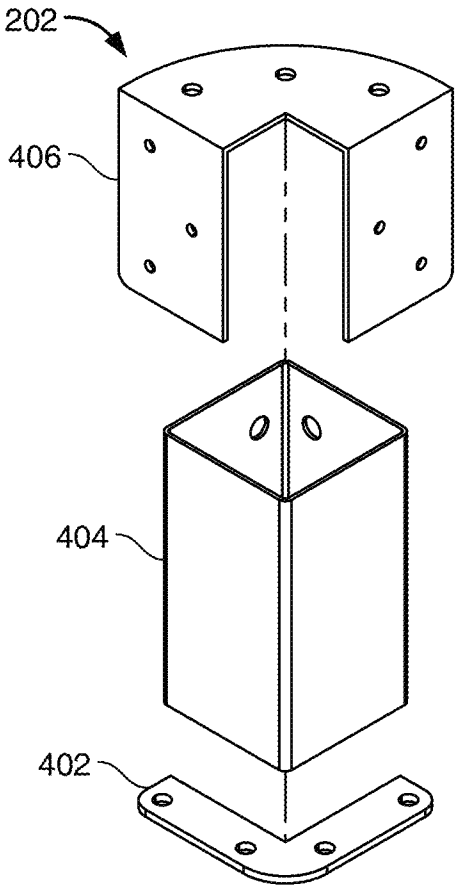
FIG. 4C shows an exploded view of FIG. 4A.
Figure 4B:
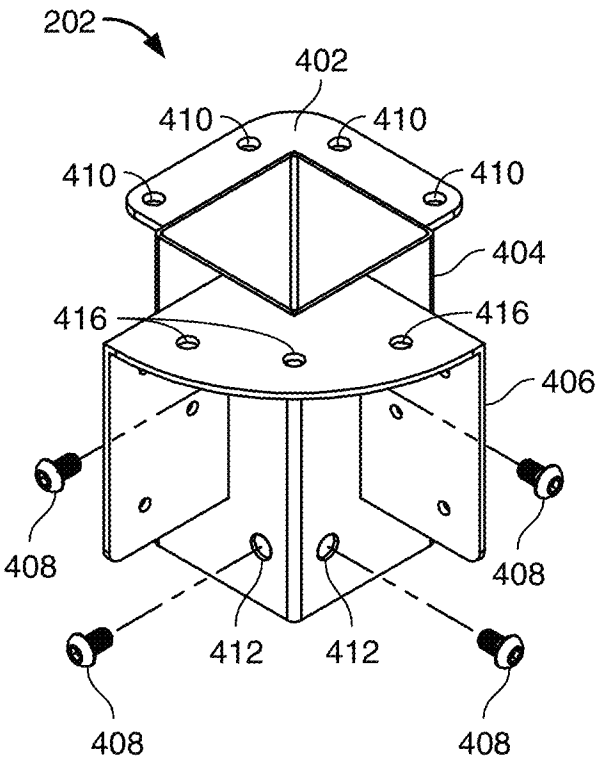
FIG. 4B shows an exploded view of mounting portion 202.
Figure 4A:
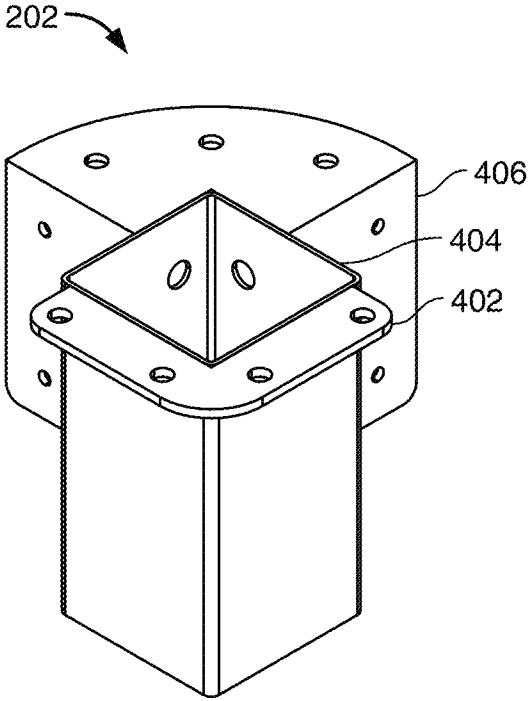
FIG. 4A shows another illustrative apparatus in accordance with principles of this matter.

FIG. 4A shows mounting portion 202. Mounting portion 202 may include mount bracket flange 402, mount bracket body 404 and mount bracket arm 406.

FIG. 4B shows an exploded view of mounting portion 202. Mounting portion 202, as shown in FIGS. 1-3 and described in the portion of the specification corresponding thereto, may be a portion of and/or share similar physical characteristics (i.e., shape, size, width, etc.) to the outer square tube. Mounting portion 202 may mount Aerolift leg 104 to a furniture item. Mounting portion 202 may include mount bracket flange 402, mount bracket arm 406 and mount bracket body 404. Mount bracket flange 402, mount bracket arm 406 and mount bracket body 404 may be combined, via welding or any other suitable attachment method, to form a mount bracket assembly or a mounting portion.

Mount bracket flange 402 may be mounted using screws fed through apertures 410 to an underside of a piece of furniture. Mount bracket flange 402 may be mounted using mount bracket arm 406. Mount bracket arm 406 may be mounted to an underside of the furniture item using apertures 416 and screws (not shown). Mount bracket body 404 may be mounted to adjustable Aerolift leg 104 using apertures 412 and screws 408.

As such, the adjustable Aerolift leg may be mounted to a furniture item. It should be noted that a furniture item may not include an apron. Mounting portion 202 may not include mount bracket arm 406. When a furniture item does not include an apron, mount bracket arm 406 may not include one or more apertures. When a furniture item does include an apron, mount bracket arm 406 may be mounted to the apron.

FIG. 4C shows an exploded view of mounting portion 202.

Figure 5B:
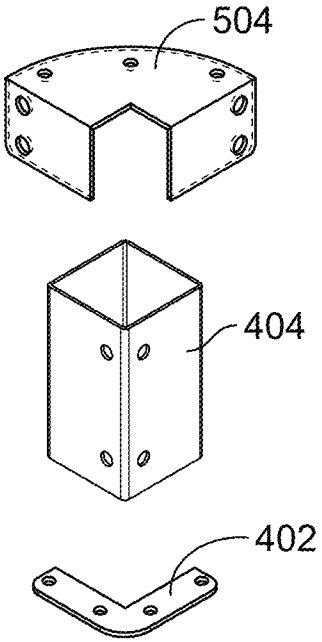
FIG. 5B shows an exploded view of FIG. 5A.
Figure 5A:
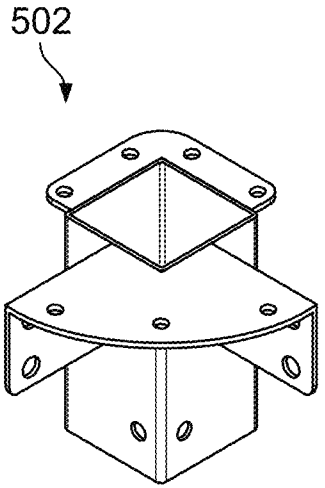
FIG. 5A shows an illustrative apparatus in accordance with principles of this matter.

FIGS. 5A and 5B show alternative mounting portion 502. FIG. 5A shows mounting portion 502.

FIG. 5B shows an exploded view of mounting portion 502. It should be noted that mount bracket body 404 and mount bracket flange 402 may be included in mounting portion 502. Mount bracket arm 504 may be included in mounting portion 502.

Figure 6C:
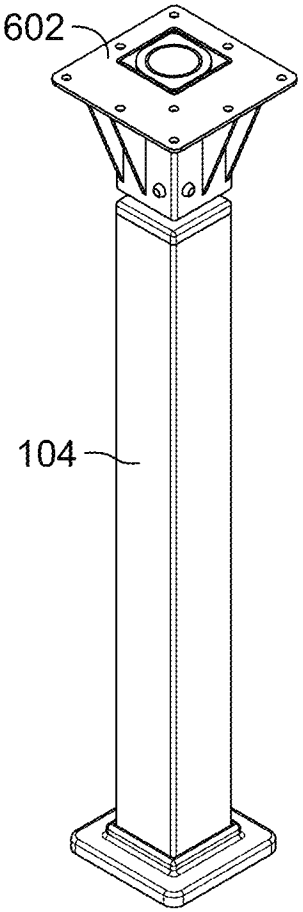
FIG. 6C shows an illustrative apparatus in accordance with principles of this matter.
Figure 6A:
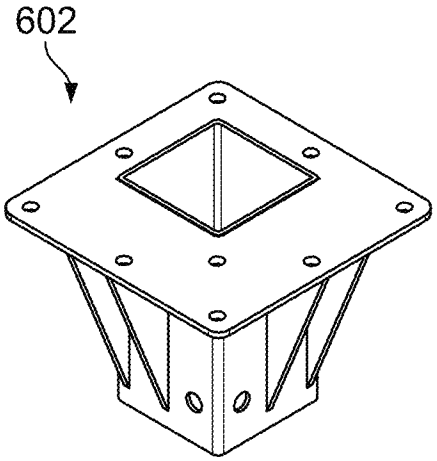
FIG. 6A shows another illustrative apparatus in accordance with principles of this matter.
Figure 6B:
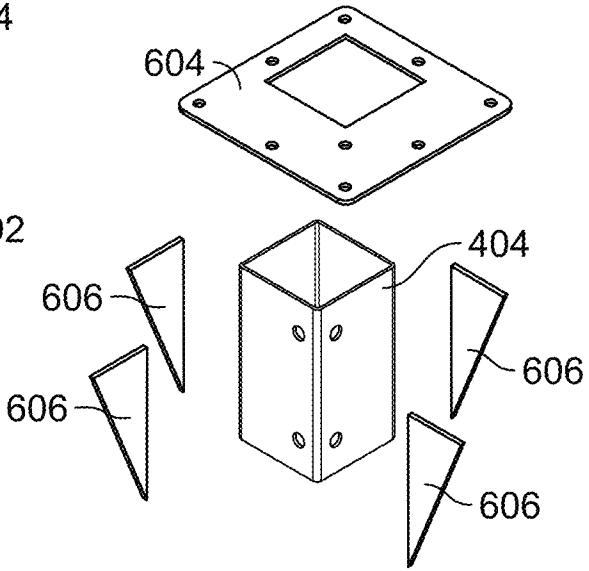
FIG. 6B shows an exploded view of FIG. 6A.

FIGS. 6A and 6B show alternative mounting portion 602. FIG. 6A shows alternative mounting portion 602.

FIG. 6B shows an exploded view of mounting portion 602. Mounting portion 602 may include mounting plate 604, mounting bracket body 404 and ridges 606. It should be noted that mounting bracket body 404 may be the same mounting body as the mounting body included in mounting portion 202 and mounting portion 502.

FIG. 6C shows mounting portion 602 attached to leg 104. It should be noted that mounting portion 602 may enable leg 104 to be attached to an underside of a furniture item. Mounting portion 602 may be directly mounted to the underside of the furniture item.

Figure 7A:
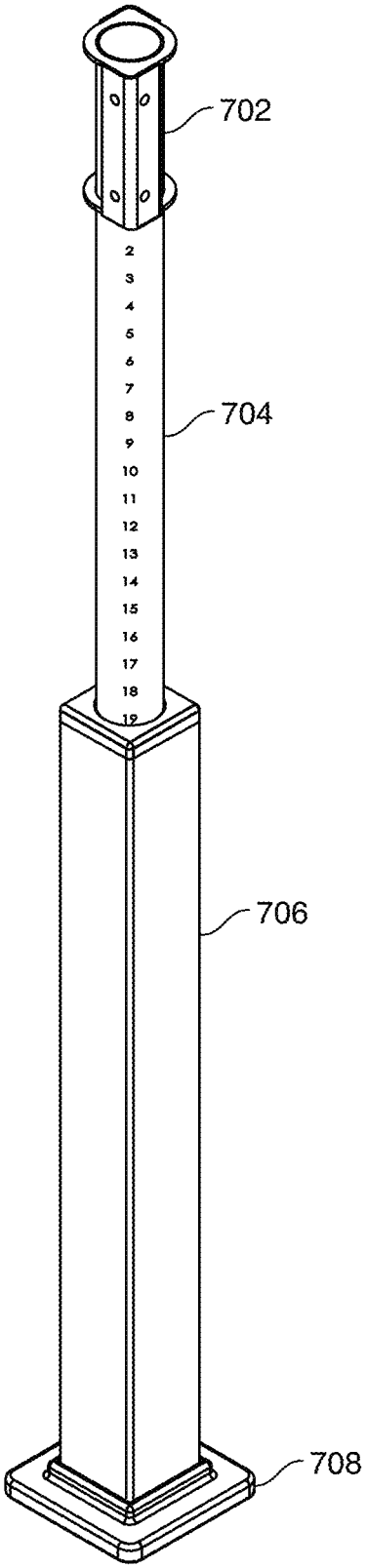
FIG. 7A shows another illustrative apparatus in accordance with principles of this matter.

FIG. 7A shows leg 104. Leg 104 may include mount flange assembly 702, inner cylindrical tube 704, outer square tube 706 and glide 708. In some embodiments, glide 708 may be removable. As such, outer square tube 706 may sit directly on a ground location. At times, outer square tube 706 may fit into a caster (not shown).

In FIG. 7A, inner cylindrical tube 704 may be extended. As such, most of inner cylindrical tube 704 may be shown. Inner cylindrical tube 704 may include numerals. The numerals may indicate to a user the height of leg 104. At times, a furniture item may include multiple legs. As such, the user may easily identify the height of each leg 104 within the furniture item. Identifying the height of each leg 104 may enable the user to adjust the furniture item to different heights and ensure that the heights of each leg within the furniture item are adjusted to the same height.

Figure 7B:
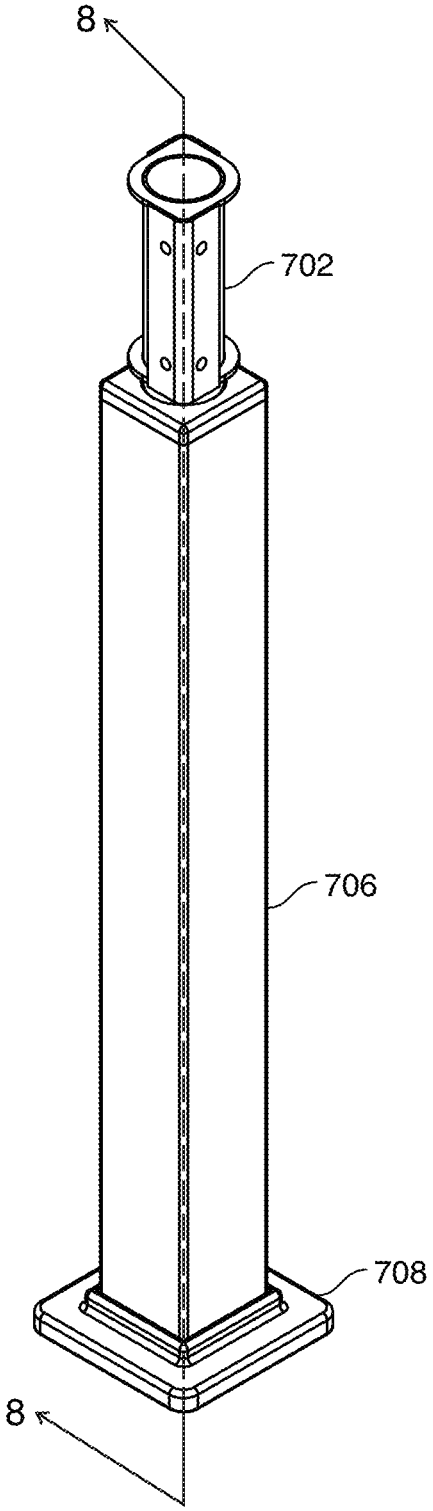
FIG. 7B shows yet another illustrative apparatus in accordance with principles of this matter.

FIG. 7B shows adjustable Aerolift leg 104. In FIG. 7B, inner cylindrical tube may be retracted into outer square tube 706. Inner cylindrical tube 704 (not viewable) in adjustable Aerolift leg 104 may be locked in at a minimum combination height. As such, inner cylindrical tube 704 is completely, or mostly not viewable.

Figure 8:
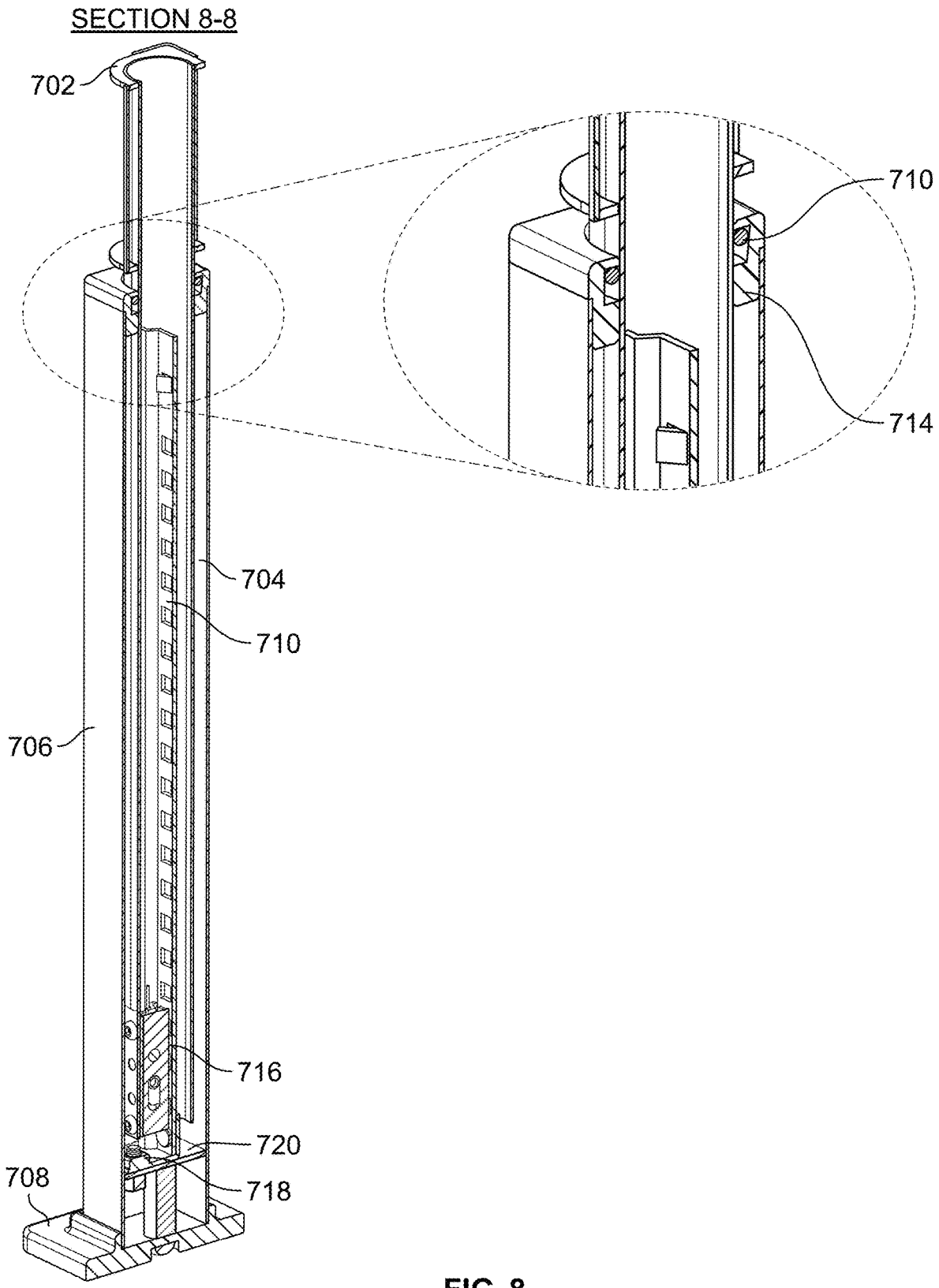
FIG. 8 shows a partial cross-sectional view, in perspective, of components of leg 104 (not fully shown) taken along view lines 8-8, shown in FIG. 7B.

FIG. 8 shows a partial cross-sectional view, in perspective, of components of leg 104 (not fully shown) taken along view lines 8-8 shown in FIG. 7B. Leg 104 includes friction member 712 and tube bushing 714 as shown in detail in FIG. 11 and described in the portion of the specification corresponding thereto.

Figure 9:
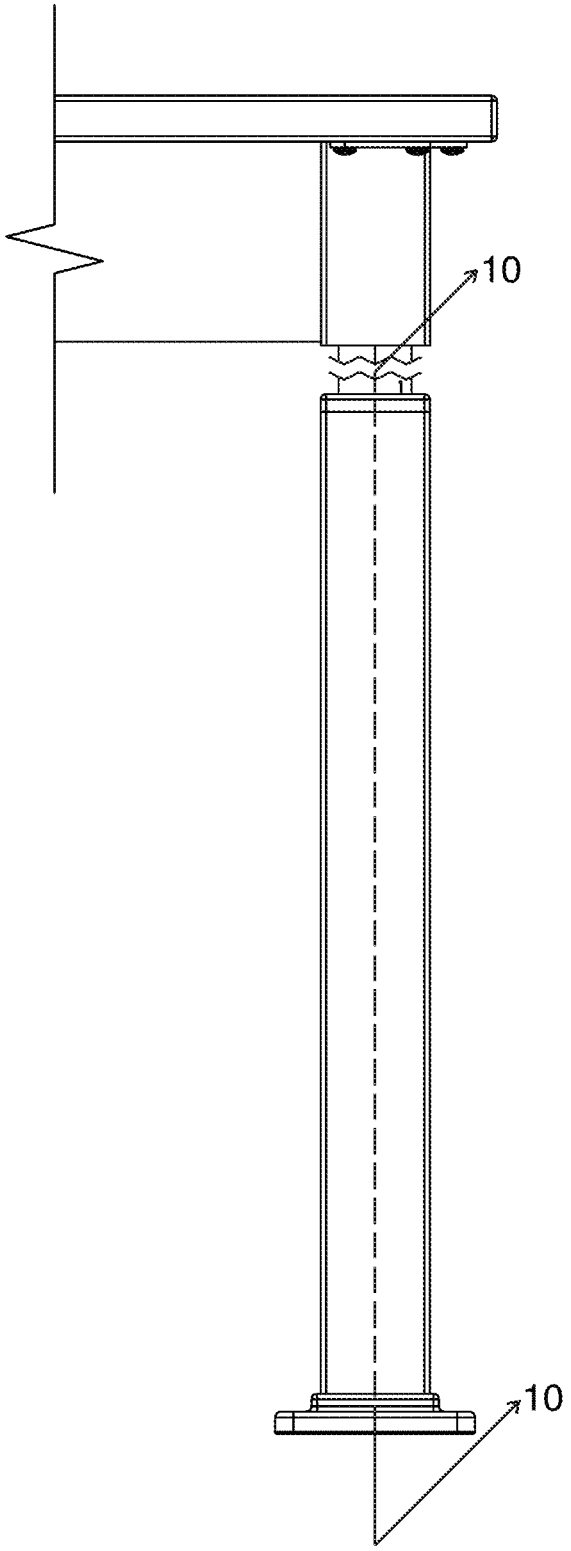
FIG. 9 shows a portion of an illustrative apparatus in accordance with principles of this matter.

FIG. 9 shows a portion of a table with an adjustable Aerolift leg. The Adjustable Aerolift leg may include the inner cylindrical tube, the outer square tube and the mounting portion of the outer square tube. The inner cylindrical tube may slidably fit into the outer square tube. The inner cylindrical tube may slide within the outer square tube and external to the outer square tube, thereby increasing or decreasing the viewable portion of the inner cylindrical tube shown between the mounting portion and the outer square tube.

It should be noted that although the inner cylindrical tube is shown in a cylindrical shape, any other suitable shape may be contemplated within the scope of the disclosure. Other suitable shapes may include a square shape, a circular shape, a triangular shape, a marquis shape and/or any other suitable shape. The distance between the mounting portion and the outer square tube may increase and decrease according to the movement of the inner cylindrical tube.

The mounting portion may be the portion of the leg that is mountable to an underside of a piece of furniture. The strength of the leg may provide the furniture with increased durability. A furniture item may be positioned on a side, such as, for example, during transport. When the furniture item is positioned on the side, the legs are in a mostly horizontal position and the tabletop is in a mostly vertical position. The mounting portion may remain secure and strong even when the furniture is positioned on its side. As such, the adjustable Aerolift leg may provide furniture with increased strength and durability.

Figure 10:
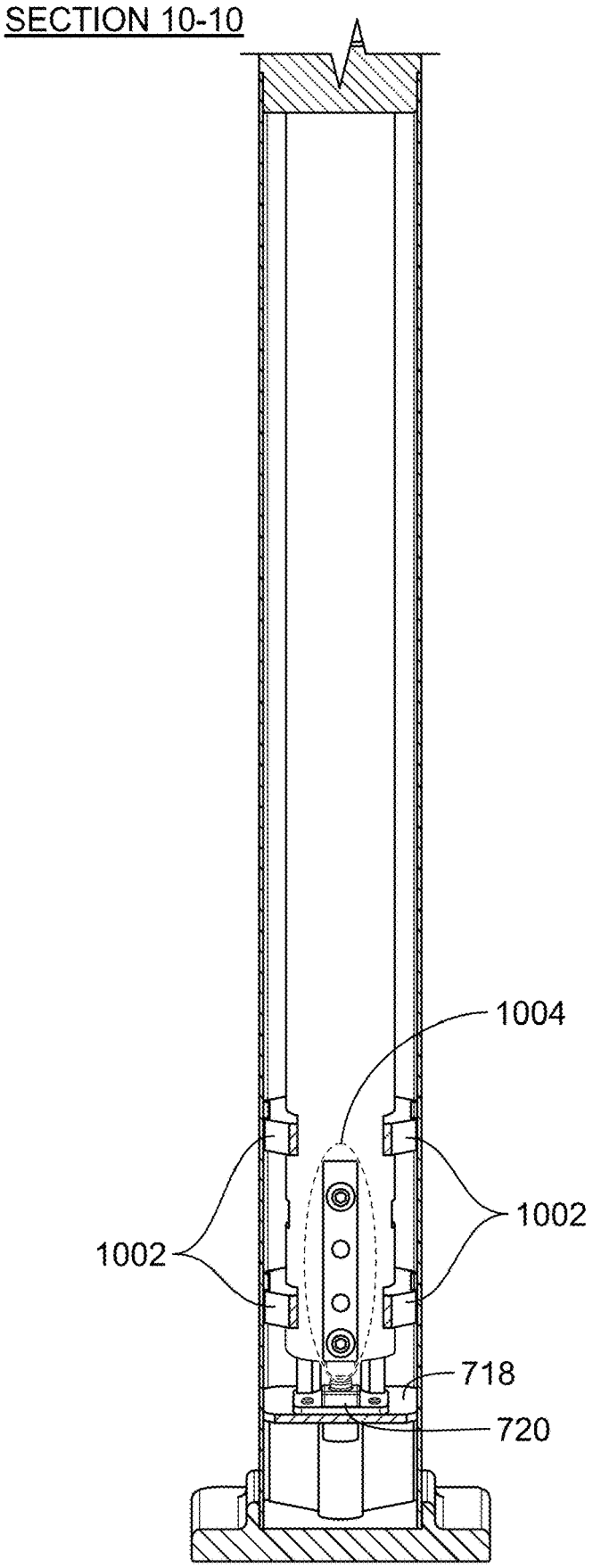
FIG. 10 shows a partial cross-sectional view, in perspective, of leg 104 (not fully shown) taken along view lines 10-10, shown in FIG. 9.

FIG. 10 shows a partial cross-sectional view, in perspective, of leg 104 (not fully shown) taken along view lines 10-10 shown in FIG. 9. Adjustable Aerolift leg 104 includes adjustment rail end cap 718, rail plate 720, rail guides 1002 and mounting plate 1004.

Figure 15:
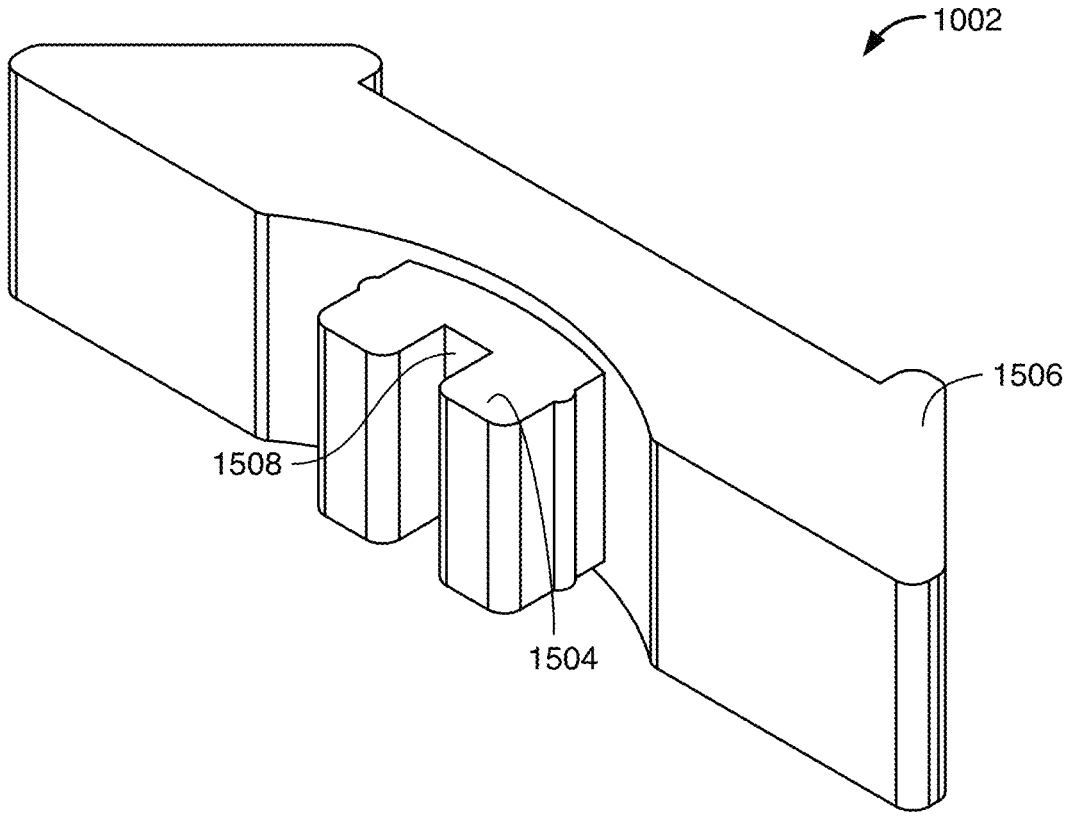
FIG. 15 shows an illustrative apparatus in accordance with principles of this matter.

Rail guides 1002 are shown in detail in FIG. 15 and described in the portion of the specification corresponding thereto. Mounting plate 1004 may be used to mount the lock mechanism to the inner cylindrical tube. As such, the inner cylindrical tube may slide within the outer square tube.

Figure 11:
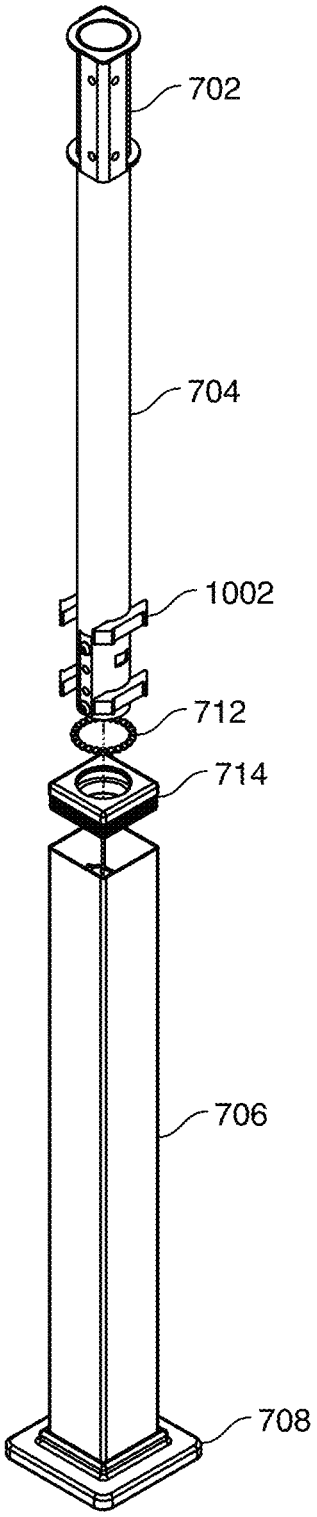
FIG. 11 shows an exploded view of the adjustable Aerolift leg assembly.

FIG. 11 shows an exploded view of the adjustable Aerolift leg assembly. The adjustable Aerolift leg assembly may include mount flange assembly 702, inner cylindrical tube 704, rail guides 1002, friction member 712, tube bushing 714, outer square tube 706 and glide 708.

Friction member 712 may be a ring shape. Friction member 712 may include a material. The material may include hard rubber or any other suitable material. Friction member 712 may be placed within tube bushing 714. Tube bushing 714 may include a hole for placement of inner cylindrical tube 704. As such, friction member 712 may be positioned between inner cylindrical tube 704 and outer square tube 706.

Friction member 712 may enable movement of inner cylindrical tube 704 within outer square tube 706. When inner cylindrical tube 704 slides within outer square tube 706, friction member 712 may provide friction to inner cylindrical tube 704. As such, inner cylindrical tube 704 may move smoothly, yet with resistance, within outer square tube 706.

Glide 708 may be located at a first or second end of outer square tube 706. The end may be a bottom end with respect to the ground. Glide 708 may fit into outer square tube 706. A screw may mount glide 708 to outer square tube 706. The screw may engage within an aperture in glide 708 and an aperture in outer square tube 706.

At times, glide 708 may be removable. In such embodiments, outer square tube 706 may fit into a caster. In certain embodiments, outer square tube 706 may be placed directly on a surface.

Figure 12:
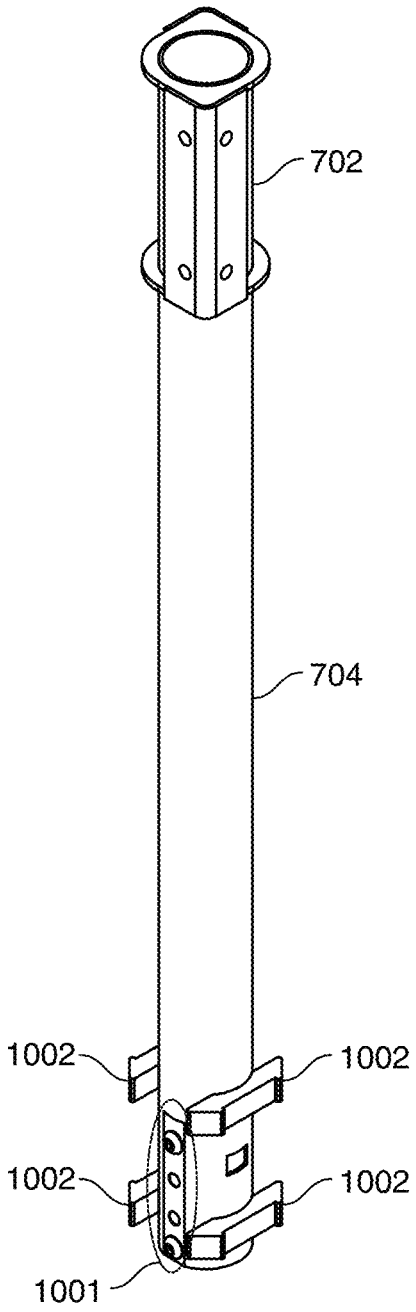
FIG. 12 shows another illustrative apparatus in accordance with principles of this matter.

FIG. 12 shows an inner cylindrical tube assembly. The inner cylindrical tube assembly may include mount flange assembly 702, inner cylindrical tube 704 and rail guides 1002. The inner cylindrical tube assembly may slide within the outer square tube (not shown) along a longitudinal axis. Mounting plate 1001 may be used to mount the lock mechanism to the inner cylindrical tube.

Figure 13A:
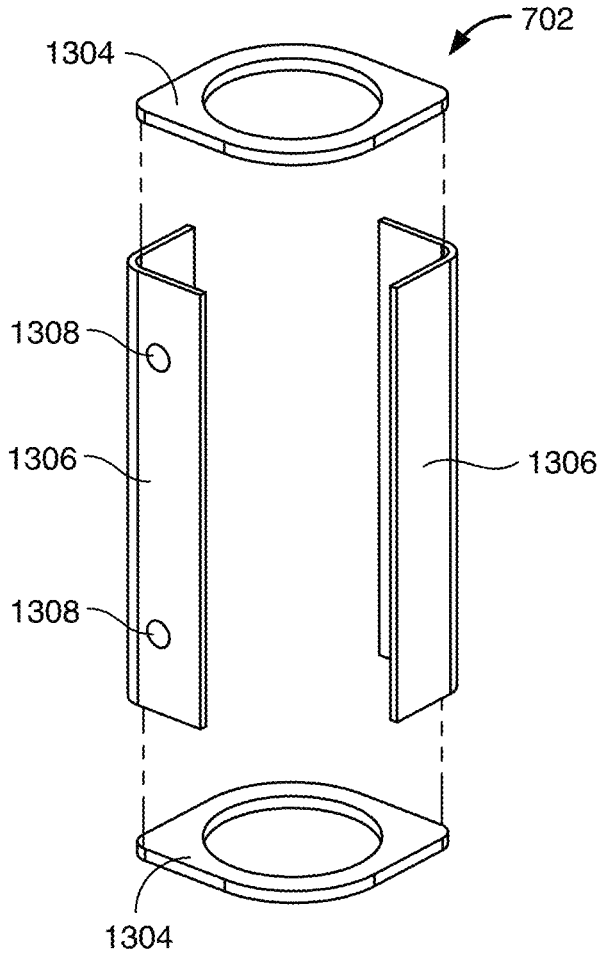
FIG. 13A shows an exploded view of mount flange assembly 702.

FIG. 13A shows an exploded view of mount flange assembly 702. Mount flange assembly 702 includes mount flange tubes 1304 and mount flange corners 1306. Mount flange corners 1306 may include apertures 1308.

Figure 13B:
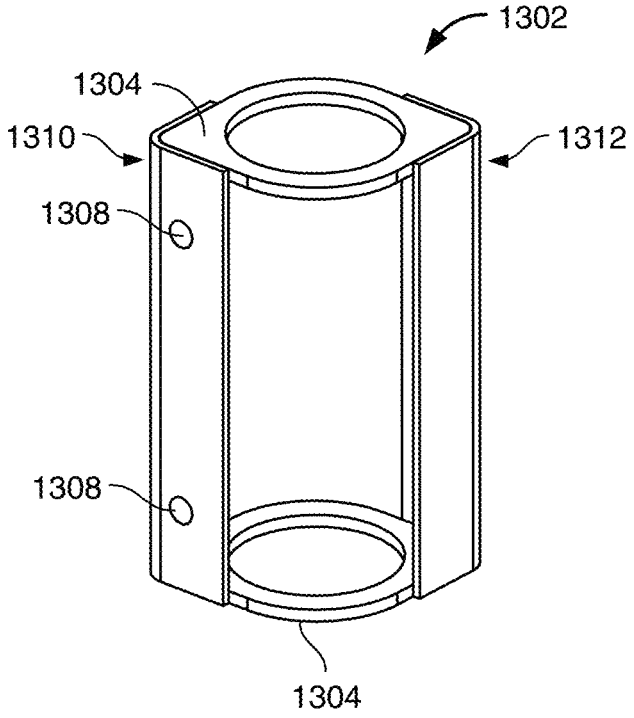
FIG. 13B shows an illustrative apparatus in accordance with principles of this matter.

FIG. 13B shows mount flange assembly 1302. Mount flange tubes 1304 and mount flange corners 1306 may be attached together to form mount flange assembly 1302. In some embodiments, mount flange tubes 1304 and mount flange corners 1306 may be welded together to form mount flange assembly 1302. Mount flange assembly 1302 may be mounted to an upper end, further from the ground, of the inner cylindrical tube, as shown in FIG. 2 and described in the portion of the specification corresponding thereto.

Mount flange assembly 1302 may fit into the outer square tube. Corners 1310 and 1312 of mount flange tube 1304 may fit into the corners of the outer square tube. Mount flange tube 1304 may be attached to an upper end of the inner cylindrical tube. As such, the movements between the inner cylindrical tube and the outer square tube may be airtight and smooth.

Mount flange assembly 1302 may fit into mounting portion 202, as shown at FIG. 2 and described in the portion of the specification corresponding thereto. Apertures 1308 may be included in mount flange assembly 1302. Apertures 1308 may be engaged with a screw to attach mount flange assembly 1302 to mounting portion 202. As such, mount flange assembly 1302 may be mounted to mounting portion 202 and inner cylindrical tube 704 (shown in FIG. 7).

Figure 14A:
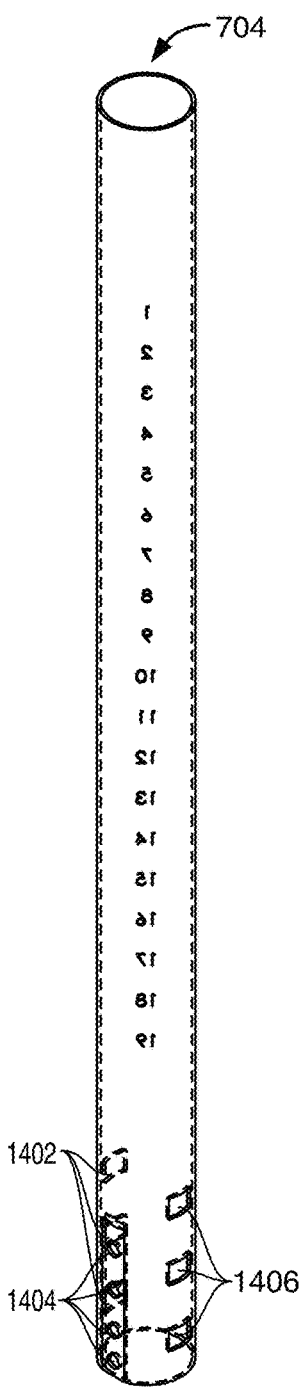
FIG. 14A shows another illustrative apparatus in accordance with principles of this matter.

FIG. 14A shows a perspective view of inner cylindrical tube 704. Inner cylindrical tube 704 may be hollow. Inner cylindrical tube 704 may include apertures 1402 and apertures 1404. Rail guides 1002 may fit into and engage with apertures 1402.

Apertures 1404 may be used to mount a lock mechanism to inner cylindrical tube 704. As such, screws may be fed through the lock mechanism into apertures 1404 to mount the lock mechanism to inner cylindrical tube 704.

It should be noted that although six of apertures 1402 may be shown within inner cylindrical tube 704, any other suitable number of apertures may be used. In certain embodiments, six apertures may maintain sufficient strength of the inner cylindrical tube and enable placement of the rail guides. Each rail guide may fit into and engage with one aperture 1402. As such, when six apertures 1402 are included in the inner cylindrical tube and four rail guides 1002 are used, two apertures 1402 may remain unoccupied.

Inner cylindrical tube 704 may be labeled with numerals. Each number may represent a height position of the leg. Inner cylindrical tube 704 may slide into outer square tube. The numerals may be used to identify height positions when inner cylindrical tube 704 slides within the outer square tube. Each number may correspond to a holding member located on the adjustment rail. As inner cylindrical tube 704 slides within the outer square tube, inner cylindrical tube 704 may lock into a position. Each number on inner cylindrical tube 704 may correspond to a position.

Figure 14B:
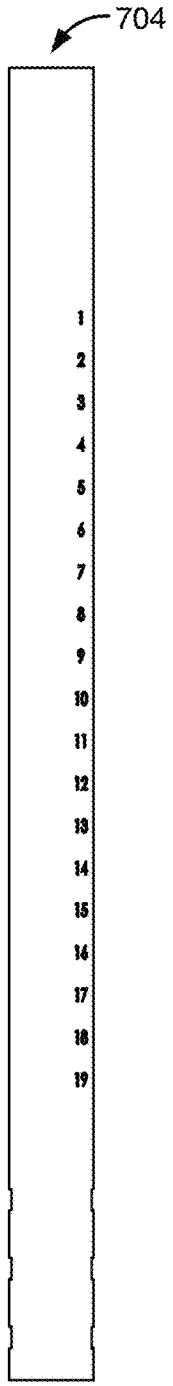
FIG. 14B shows a right view of the apparatus shown in FIG. 14A.

FIG. 14B shows a right view of inner cylindrical tube 704. Inner cylindrical tube 704 includes a plurality of numbers. Each number corresponds to a click in position of the leg. As such, when the leg is in a clicked in position, the height of the leg may be determined based on the number. Therefore, when more than one leg is mounted to a single furniture item, each of the legs may be clicked in at the same position, thereby ensuring the strength of the furniture item. There may be two sections of identical numbers on each inner cylindrical tube 704. The clicked in position may be visible from a plurality of angles. As such, a user may easily adjust the leg to a clicked in position identical to an additional leg on the furniture item. It should be noted that the second set of numbers is not visible on FIG. 14B to clearly show the first set of numbers.

Figure 14C:
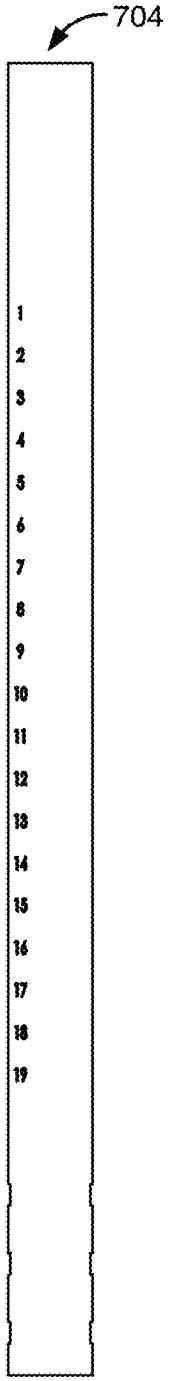
FIG. 14C shows a left view of the apparatus shown in FIG. 14A.

FIG. 14C shows a left view of inner cylindrical tube 704. It should be noted that only the second set of numbers, although a first set of numbers is located on inner cylindrical tube 704, are visible in FIG. 14C to clearly show the second set of numbers.

Figure 14D:
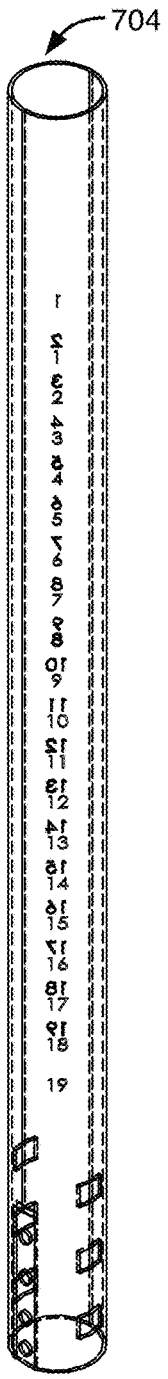
FIG. 14D shows a transparent perspective view of the apparatus shown in FIG. 14A.

FIG. 14D shows a transparent perspective view of inner cylindrical tube 704. Both sets of numbers are visible in FIG. 14D.

FIG. 15 shows rail guide 1002. There may be a plurality of rail guides in the adjustable Aerolift leg. The plurality of rail guides may include four rail guides or any other suitable number of rail guides. Rail guide 1002 may include rail guide portion 1504 and inner cylindrical tube portion 1506. Rail guide 1002 may be attached, via welding or any other suitable attachment method, to inner cylindrical tube 704 at inner cylindrical tube portion 1506. Inner cylindrical tube 704 is shown in FIG. 14A and described in the portion of the specification corresponding thereto.

Rail guide portion 1504 may fit into an aperture, shown in FIG. 14A as 1406, located within inner cylindrical tube 704. Rail guide portion 1504 may include ribs. The ribs may secure rail guide portion 1504 within apertures 1406 in the inner cylindrical tube. Apertures 1402 are shown in FIG. 14A and described in the portion of the specification corresponding thereto. As such, rail guide portion 1504 may be attached, via welding or any other suitable attachment method, to inner cylindrical tube 704.

Rail guide 1002 may include non-friction material. The material rail may include plastic, nylon, acetal or any other similar material. Rail guide 1002 may be used as a rail guide for an adjustment rail.

The adjustment rail may be located inside inner cylindrical tube 704. Rail guide 1002 may secure the adjustment rail within inner cylindrical tube 704. There may be indentation 1508. Indentation 1508 may hold the adjustment rail (not shown). The adjustment rail may include two ends. Each of the two ends may slide into indentation 1508 on one or more rail guides. The rail guides may hold the adjustment rail in place.

Figure 16:
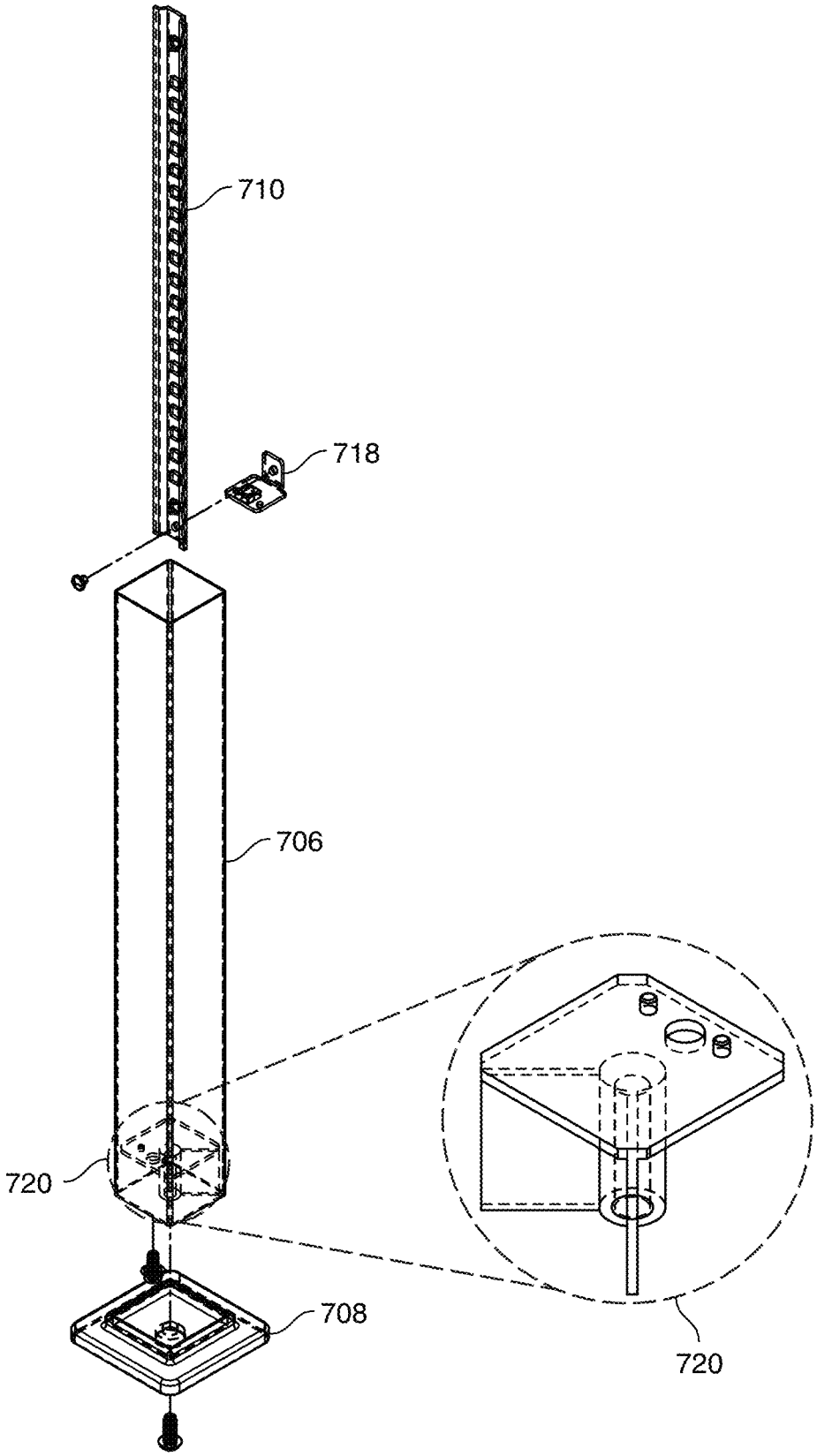
FIG. 16 shown another illustrative apparatus in accordance with principles of this matter.

FIG. 16 shows the mounting of adjustment rail 710 into leg 104. Adjustment rail 710 may be mounted to leg 104 with adjustment rail end cap 718 and rail plate 720. Rail plate 720 may be mounted into glide 708. As such, the adjustment rial may be mounted into leg 104.

Figure 17A:
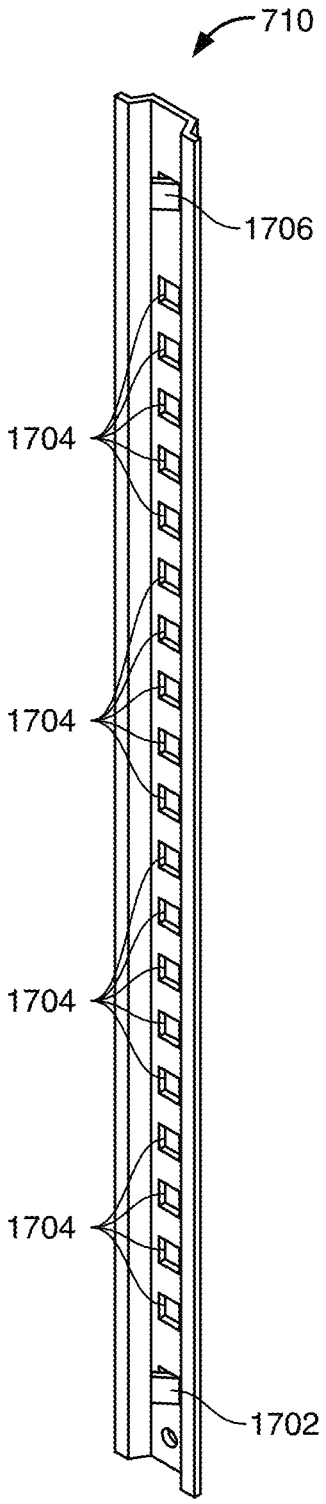
FIG. 17A shows yet another illustrative apparatus in accordance with principles of this matter.

FIG. 17A shows adjustment rail 710. Adjustment rail 710 includes holding members 1704, maximum holding member 1706 and minimum holding member 1702. A plurality of holding members 1704 may be shown. Adjustment rail 710 may include nineteen holding members or any other suitable number of holding members.

Holding members 1704 may lock the adjustable Aerolift leg in a position. The lock mechanism, shown in FIGS. 18A and 18D and described in the portion of the specification corresponding thereto, may lock into one of holding members 1704. As such, the adjustable Aerolift leg may be locked into a position.

Adjustment rail 710 may be disposed inside the inner cylindrical tube 704. Adjustment rail 710 may be held in a position using the rail guides. Adjustment rail 710 (not shown) may enable the adjustable Aerolift leg to adjust to a plurality of combination heights. The lock mechanism, attached to the inner cylindrical tube, may enable adjustability by locking into one of the holding members when the inner cylindrical tube slides in an upward position. The combination height may combine the visible height of the inner cylindrical tube (external to the outer square tube), the height of the outer square tube and mounting portion 202.

The inner cylindrical tube may slide in an upward position along a longitudinal axis. When the inner cylindrical tube slides to a maximum position, the lock mechanism may reach maximum holding member 1706. Upon reaching maximum holding member 1706, the inner cylindrical tube may be retractable along the longitudinal axis and returnable to the minimum holding member 1702. It should be noted that once the lock mechanism locks into, or passes, a holding member, the inner cylindrical tube cannot return to the locked in or passed holding member. The limitation of the leg to be unable to retract unless completely expanded may increase the strength and durability of the adjustable Aerolift leg. When the lock mechanism is locked into any of the holding members, the leg may be able to support a maximum amount of weight supportable by the leg.

Upon reaching maximum holding member 1706, inner cylindrical tube 704 and the lock mechanism may return to a starting position that corresponds to minimum holding member 1702. Upon reaching minimum holding member 1702, inner cylindrical tube 704 may again slide upward along the longitudinal axis.

Figure 17B:
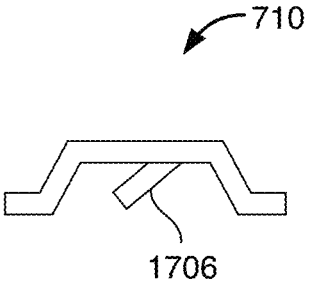
FIG. 17B shows a top view of FIG. 17A.

FIG. 17B shows a top view of adjustment rail 710. Adjustment rail 710 may include maximum holding member 1706, holding members 1704 and minimum holding member 1702. Maximum holding member 1706 and minimum holding member 1702 may include a tapered surface. The lock mechanism may not lock into the maximum holding member and/or the minimum holding member. When the lock mechanism reaches the tapered surface of the maximum holding member, the inner cylindrical tube may be enabled to return to the minimum height. As such, the inner cylindrical tube may return to the minimum holding member upon reaching the maximum holding member.

Figure 18A:
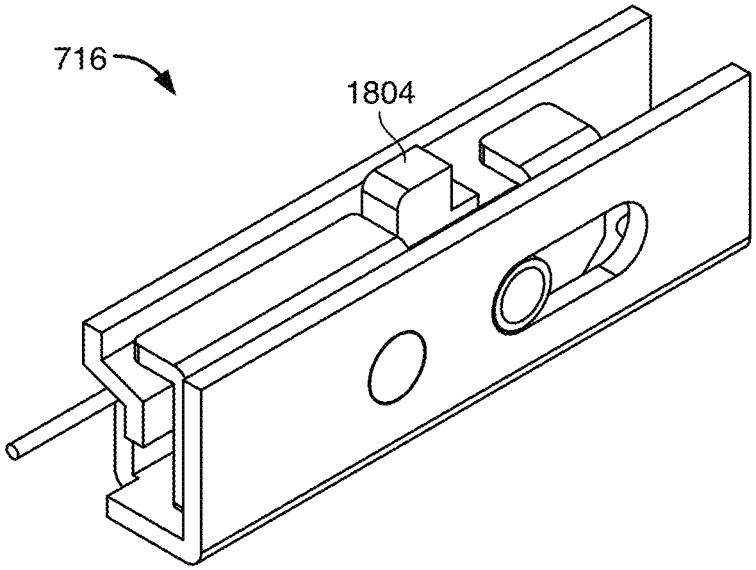
FIG. 18A shows an illustrative apparatus in accordance with principles of this matter.

FIG. 18A shows lock mechanism 716. Lock mechanism 716 may be mounted to a bottom portion, with respect to the ground, of the inner cylindrical tube. Lock mechanism 716 may lock into one of the holding members located within the adjustment rail. The inner cylindrical tube may lock into one of a plurality of positions using lock mechanism 716.

Figure 18B:
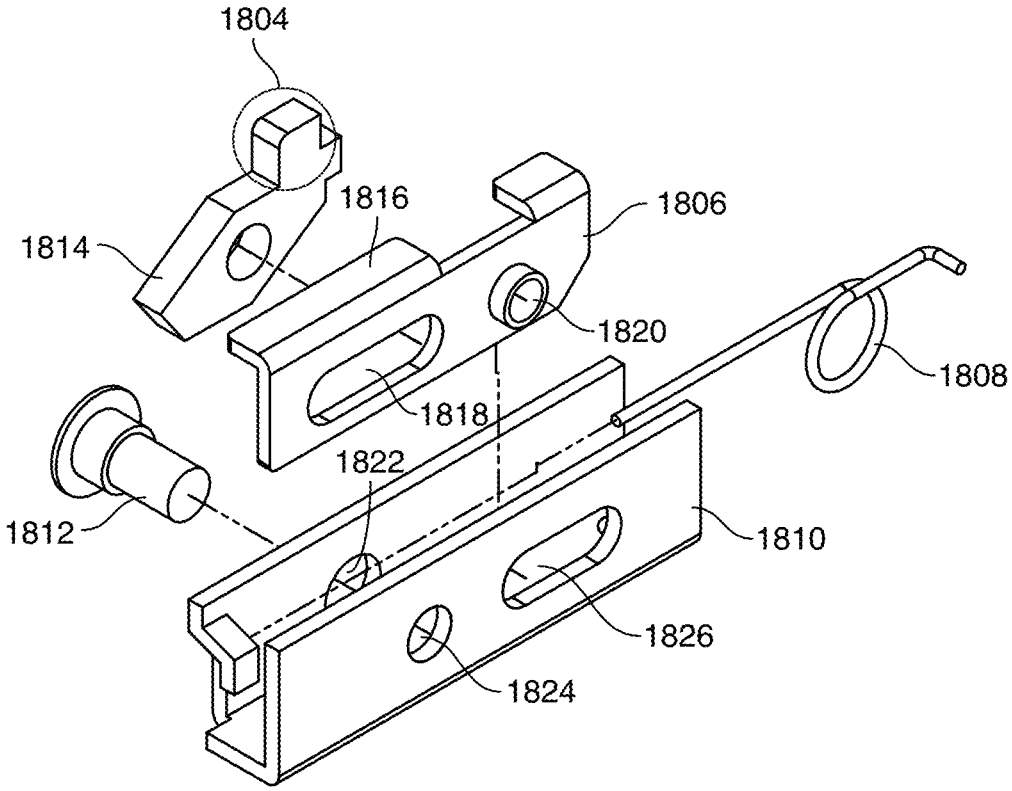
FIG. 18B shows an exploded view of FIG. 18A.

FIG. 18B shows an exploded view of lock mechanism 716. Lock mechanism 716 includes lock mechanism slide 1806, lock mechanism spring 1808, lock mechanism shell 1810, lock mechanism rivet pin 1812 and lock mechanism arm 1814. Lock mechanism arm 1814 may include protrusion 1804. Protrusion 1804 may lock into a holding member located on the adjustment rail. As such, the lock mechanism may lock into the adjustment rail.

Lock mechanism slide 1806 may include lock mechanism shield 1816, oblong-shaped opening 1818 and circular protrusion 1820. Lock mechanism shell 1810 may include circular opening 1822, circular opening 1824 and oblong opening 1826. Lock mechanism slide 1806 fits into lock mechanism shell 1810. Circular protrusion 1820 fits into oblong opening 1826. Rivet pin 1812 is placed through oblong-shaped opening 1818 in lock mechanism slide 1806 and circular opening 1824 in shell 1810. Oblong-shaped opening 1818 and oblong opening 1826 may enable lock mechanism slide 1806 to slide within lock mechanism shell 1810. When lock mechanism slide 1806 is slidden to an end of lock mechanism shell 1810 closer to circular opening 1824, protrusion 1804 may be unshielded and enabled to enter each of the holding members. When lock mechanism slide 1806 is slidden to an end of lock mechanism shell 1810 further from circular opening 1824, protrusion 1804 may be shielded by lock mechanism shield 1816 and prevented from entering each of the holding members. The tapered surface of the first holding member and the last holding member may control the shield.

As such, lock mechanism 1802 may be an adjustable mechanism. Lock mechanism 1802 may provide adjustability to the inner cylindrical tube within the outer square tube. It should be noted that lock mechanism arm 1814 may be a portion of the lock mechanism that fits into a holding member. When lock mechanism 1802 is secure within a holding member, lock mechanism 1802 and the inner cylindrical tube may be secured in a position with respect to the outer square tube. However, when lock mechanism 1802 is not secured within a holding member, the lock mechanism and inner cylindrical tube may slide within the outer square tube.

Figure 18C:
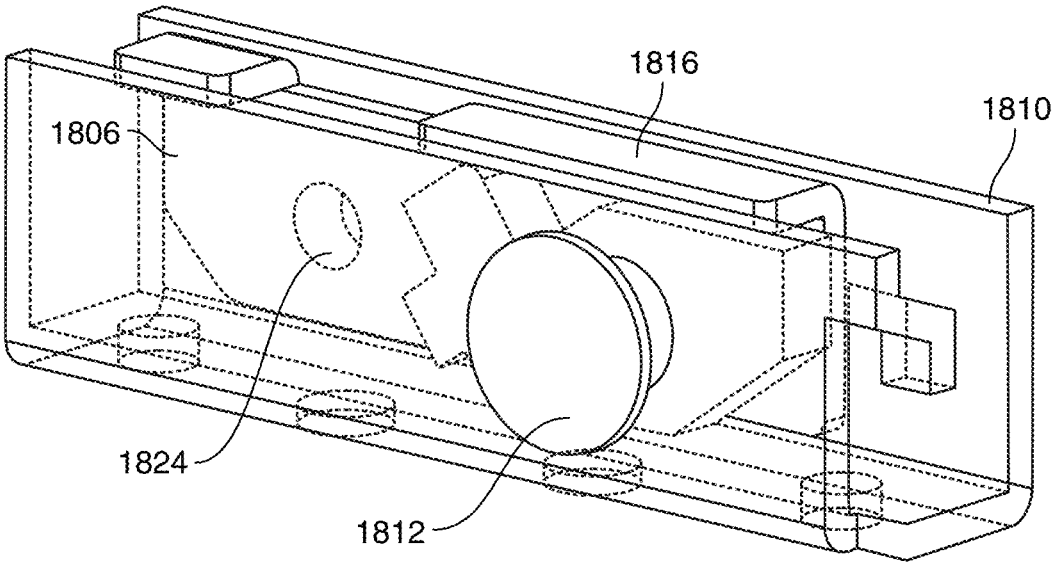
FIG. 18C shows another illustrative apparatus in accordance with principles of this matter.

FIG. 18C shows the lock mechanism when lock mechanism shield 1816 is completely covering protrusion 1804. As such, the lock mechanism and the inner cylindrical tube may slide down and return to a sliding position.

Figure 18D:
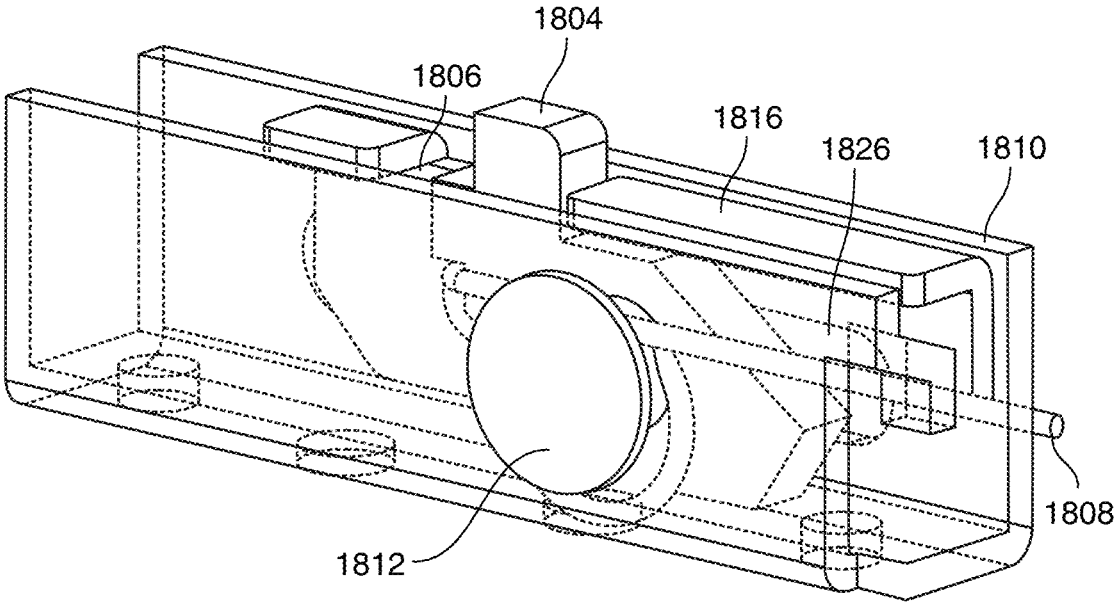
FIG. 18D shows yet another illustrative apparatus in accordance with principles of this matter.

FIG. 18D shows the lock mechanism when protrusion 1804 is in a position to click into a holding member. Protrusion 1804 may be in a position when the lock mechanism is sliding in an upward position.

Figure 19B:
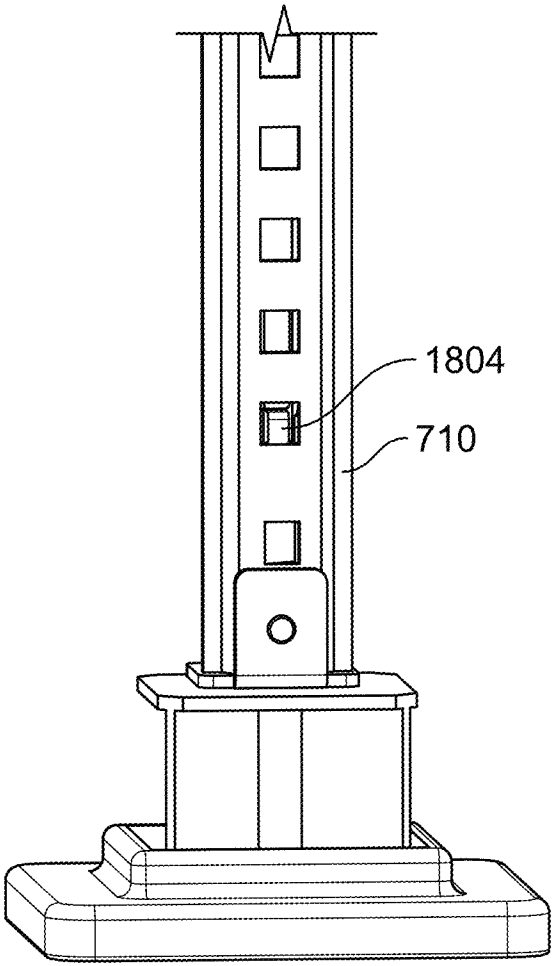
FIG. 19B shows a rear view of FIG. 19A.
Figure 19A:
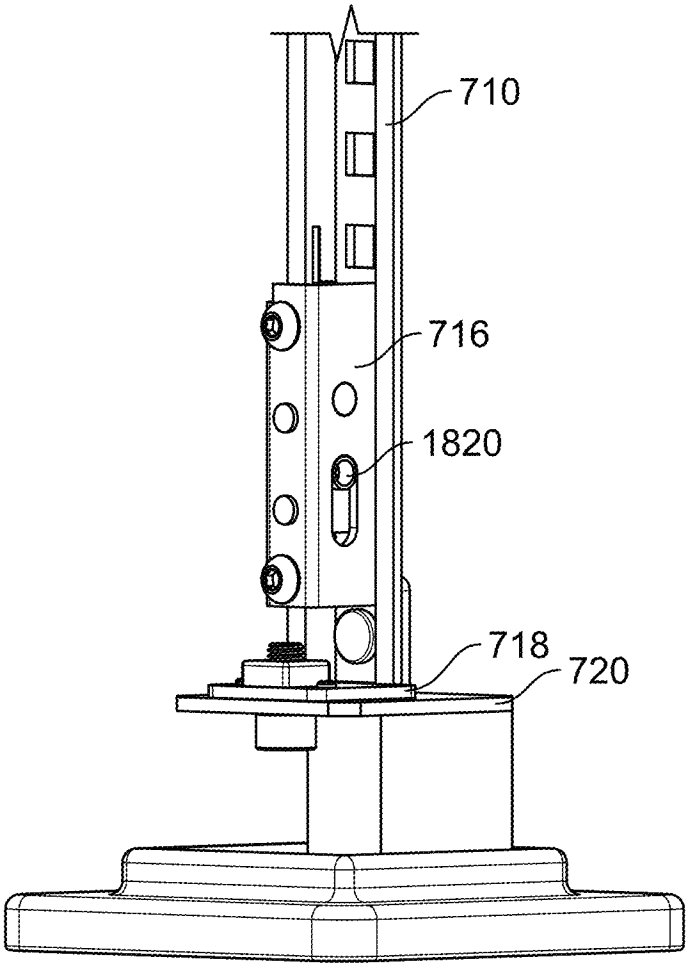
FIG. 19A shows still another illustrative apparatus in accordance with principles of this matter.

FIG. 19A shows lock mechanism 716 when engaged in a holding member. The holding member shown in FIG. 19A is the holding member above the minimum holding member. Circular protrusion 1820 is shown towards the top of the oblong hole. In such a position the lock mechanism shield is unengaged.

FIG. 19B shows a rear view of FIG. 19A. Protrusion 1804 is shown clicked into the holding member.

Figure 19C:
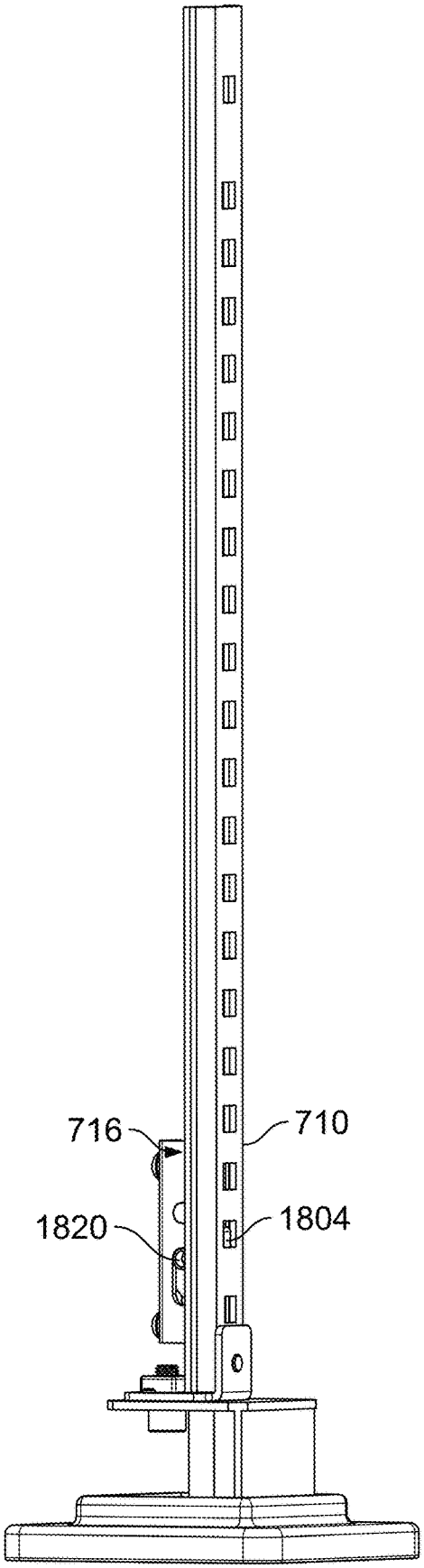
FIG. 19C shows a front perspective view of FIG. 19A.

FIG. 19C shows a front perspective view of FIG. 19A.

Figure 19D:
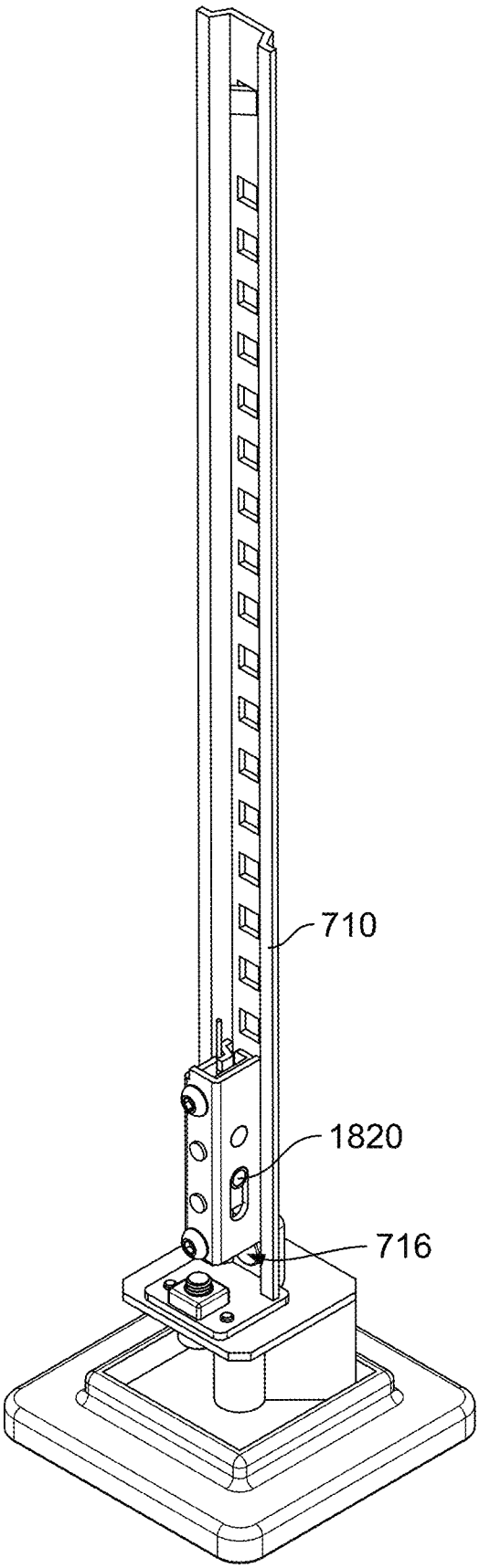
FIG. 19D shows an illustrative apparatus in accordance with principles of this matter.

FIG. 19D shows a top perspective view of the lock mechanism descending into the minimum holding member.

Figure 19E:
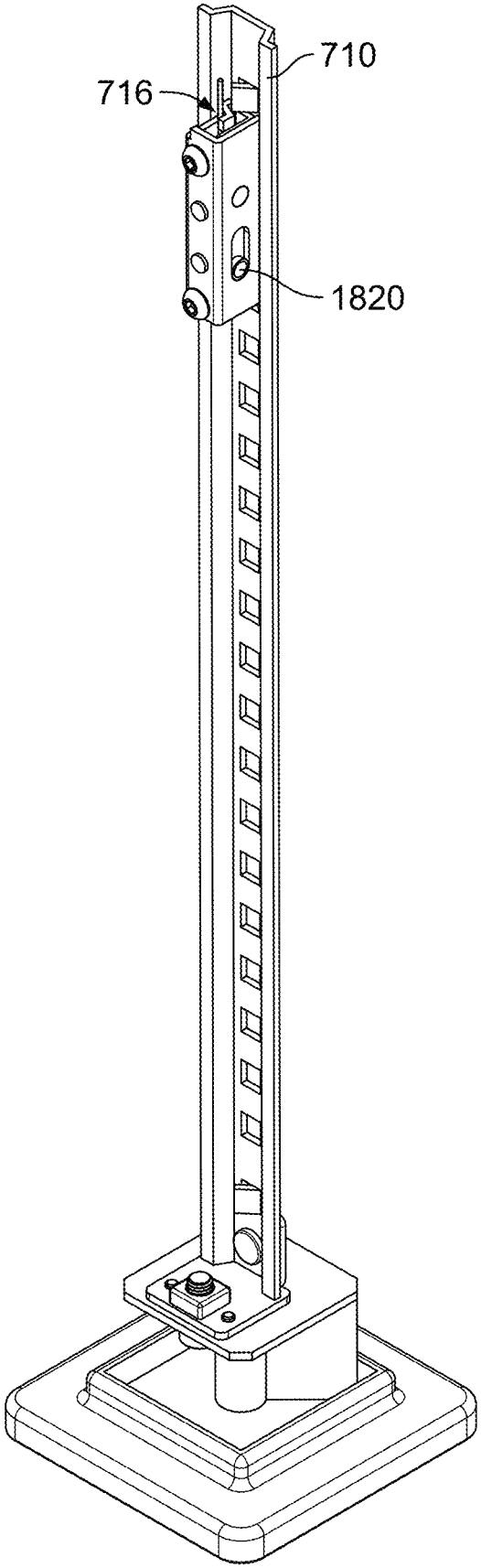
FIG. 19E shows a top perspective view of an illustrative apparatus in accordance with principles of this matter.

FIG. 19E shows a top perspective view of the lock mechanism after sliding into the maximum holding member. Upon reaching the maximum holding member the lock mechanism begins descending. It should be noted that circular protrusion 1820 is at the bottom the oblong hole and is therefore not engageable.

Figure 20:
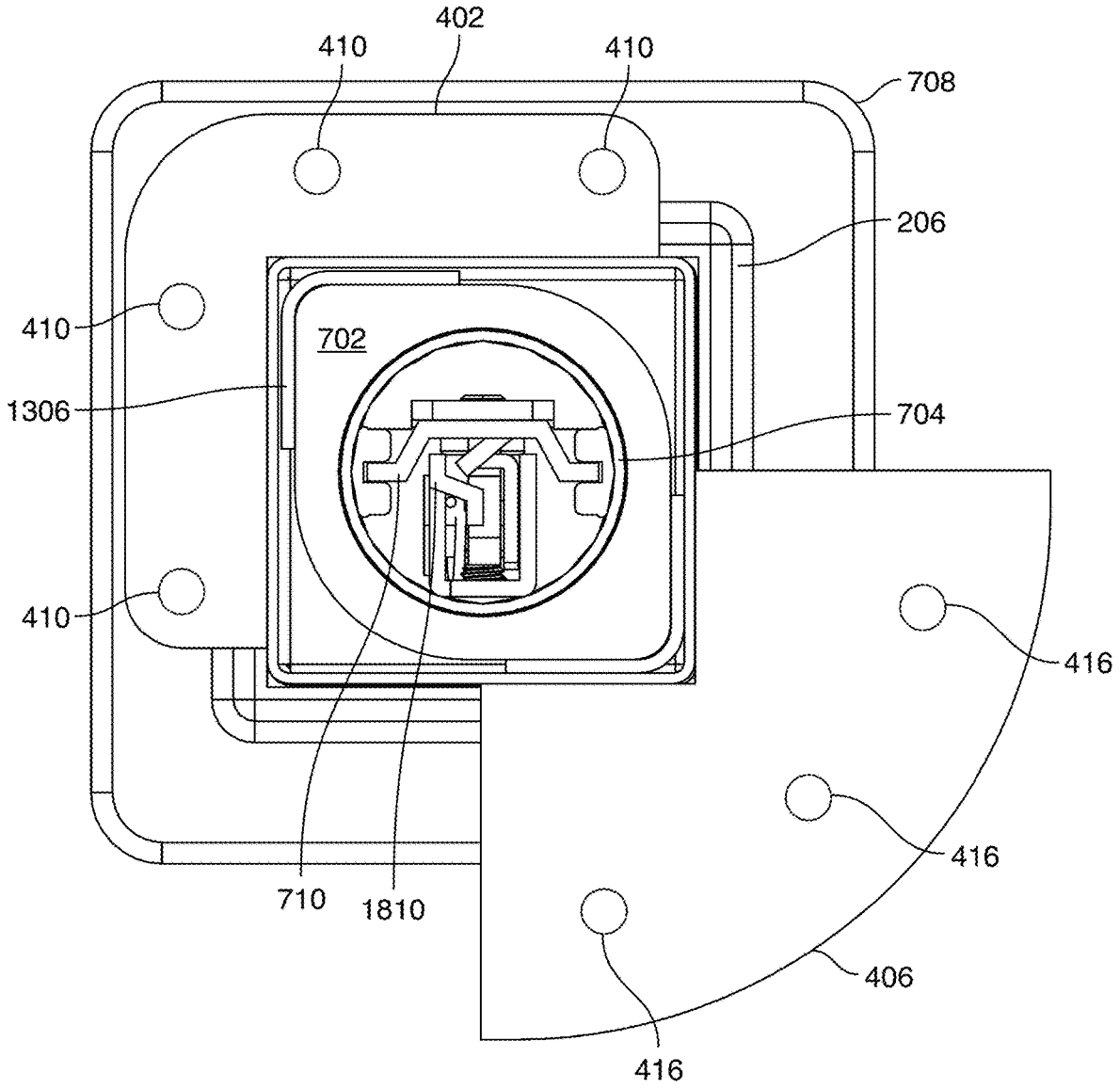
FIG. 20 shows a top view of the adjustable Aerolift leg.

FIG. 20 is a top view of the adjustable Aerolift leg. The adjustable Aerolift leg may be mounted to an underside of a furniture item. The adjustable Aerolift leg may include inner cylindrical tube 704, outer square tube 706, mount flange tube 1304, mount flange corner 1306, rail guide 1002, glide 708, mount bracket flange 402, mount bracket arm 406, adjustment rail 710 and lock mechanism shell 1810. The adjustable Aerolift leg may also include apertures 1404. Apertures 1404 may be used to mount the adjustable Aerolift leg to an underside of a piece of furniture.

Figure 21:
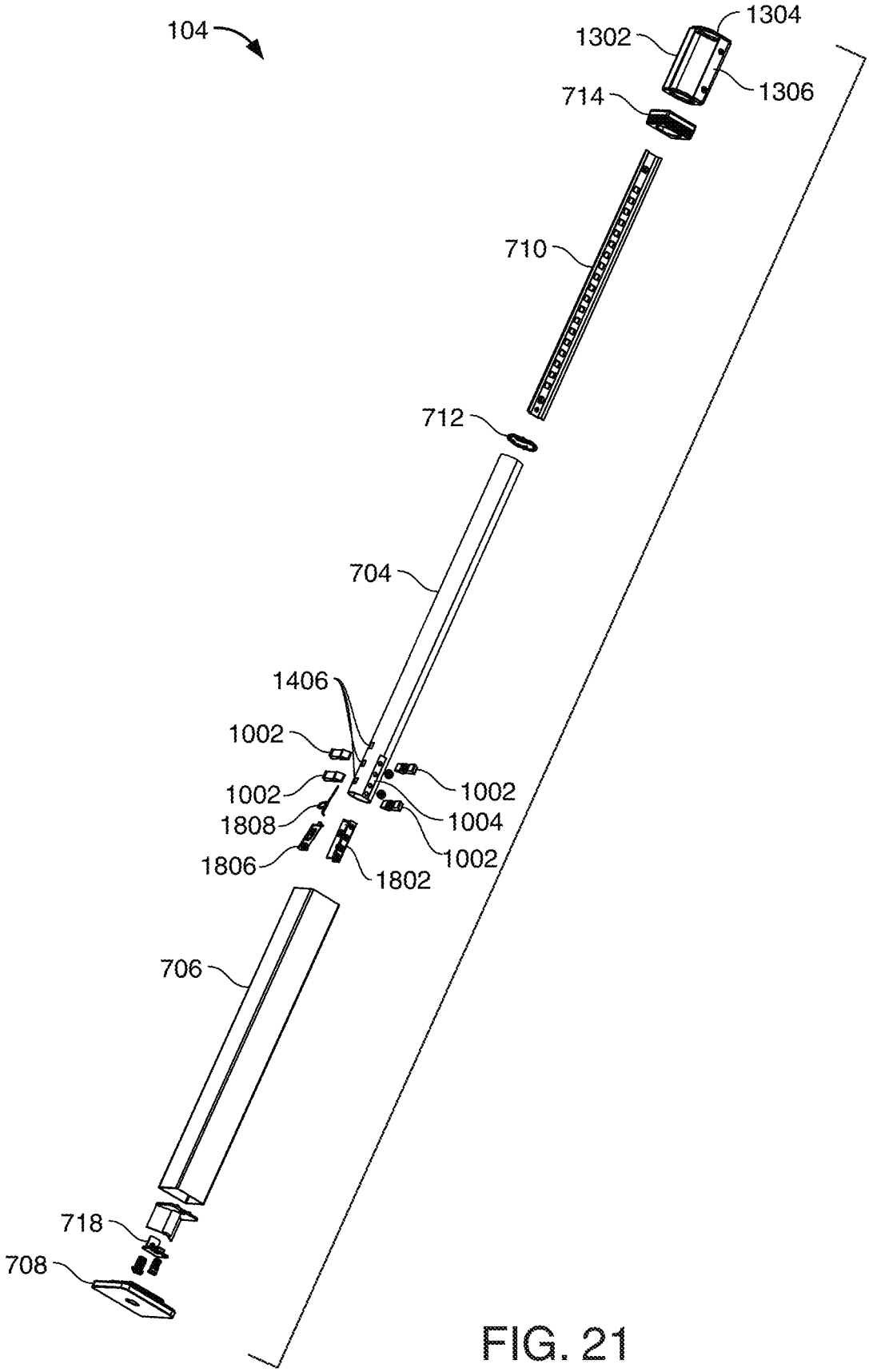
FIG. 21 shows a fully exploded view of the adjustable Aerolift leg.

FIG. 21 shows a fully exploded view of adjustable Aerolift leg 104.

Figure 22:
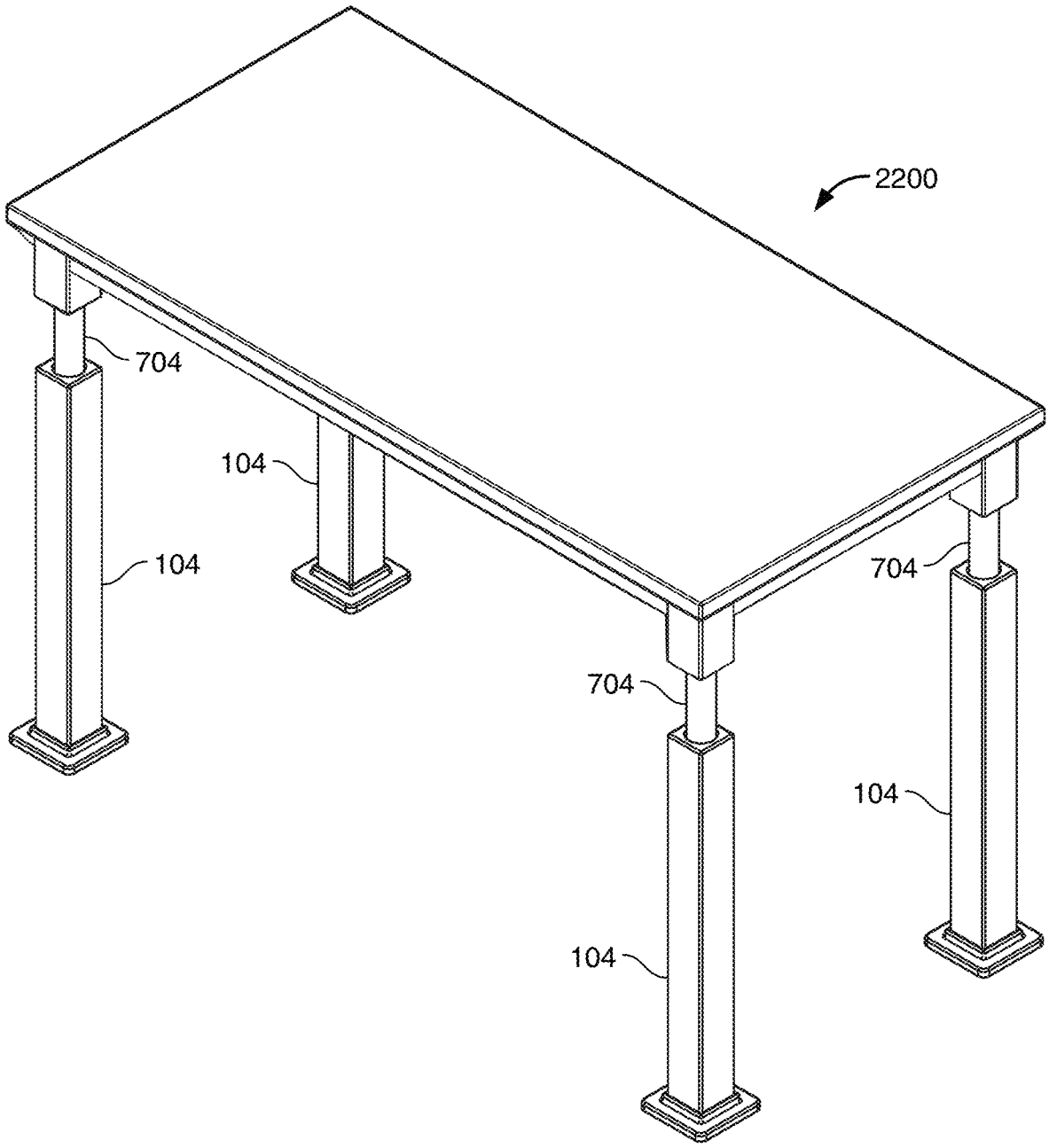
FIG. 22 shows an illustrative apparatus in accordance with principles of this matter.

FIG. 22 shows apparatus 2200. Apparatus 2200 is a table with four adjustable Aerolift legs. The adjustable Aerolift legs may be adjusted to a plurality of combination heights. The combination heights may include the height of the outer square tube and the height of the inner cylindrical tube viewable external to the outer square tube. It should be noted that in some embodiments the inner cylindrical tube may not be viewable or may be minimally viewable. In such embodiments, the combination height may include the height of the outer square tube.

Thus, methods and systems for an adjustable Aerolift leg are provided. Persons skilled in the art will appreciate that the present invention can be practiced by other than the described embodiments, which are presented for purposes of illustration rather than of limitation, and that the present invention is limited only by the claims that follow.

What is claimed is:

1. An adjustable Aerolift leg comprising:

an outer square tube extending along a longitudinal axis;

an inner cylindrical tube slidably fitted at least partially within the outer square tube said inner cylindrical tube slidable along the longitudinal axis;

a mount flange assembly fixedly coupled to a first end of the inner cylindrical tube;

a lock mechanism located at an opposing end of the inner cylindrical tube, said lock mechanism placed between the outer square tube and the inner cylindrical tube for locking relative movements therebetween;

an adjustment rail disposed inside the inner cylindrical tube, the adjustment rail for receiving the lock mechanism at one of several relative positions; and a friction member located on top of the outer square tube, the friction member placed in between the inner cylindrical tube and the outer square tube, and when a position with respect to the outer square tube is changed, the friction member enables movement of the inner cylindrical tube along the longitudinal axis.

2. The adjustable Aerolift leg of claim 1 wherein the adjustable Aerolift leg is adjustable, using the inner cylindrical tube, between a plurality of combination heights.

3. The adjustable Aerolift leg of claim 2 wherein, a combination height between the outer square tube and the inner cylindrical tube is configured to be reduced only after the outer square tube and the inner cylindrical tube reached a maximum combination height.

4. The adjustable Aerolift leg of claim 3 wherein when the inner cylindrical tube has reached the maximum combination height:

the inner cylindrical tube is operable to be reduced; and the inner cylindrical tube is operable to be returned to a minimum height; and when the inner cylindrical tube is at the minimum height, the inner cylindrical tube is operable to be adjusted to any of the plurality of combination heights.

5. The adjustable Aerolift leg of claim 2 wherein the inner cylindrical tube clicks in, using the lock mechanism, at each of the plurality of combination heights.

6. The adjustable Aerolift leg of claim 2 wherein when the inner cylindrical tube clicks in at each of the plurality of combination heights the adjustable Aerolift leg is configured to hold at least a maximum weight; and wherein, the maximum weight is identical for each of a plurality of locking positions.

7. The adjustable Aerolift leg of claim 1 wherein the leg is operable to be mounted to at least one of an underside of a tabletop, an underside of a desk, an underside of a chair, an underside of a stool and an underside of a bed.

8. The adjustable Aerolift leg of claim 1 wherein the leg is operable to be mounted to an underside of a piece of furniture.

* * * * *